US005483272A

United States Patent [19]

Mukataka et al.

[11] Patent Number: 5,483,272

[45] Date of Patent: Jan. 9, 1996

[54] IMAGE FORMING APPARATUS AND METHOD FOR OBTAINING SMOOTH CHARGING, EXPOSURE AND DEVELOPMENT

[75] Inventors: Hisashi Mukataka; Ryushi Imoo; Hidemasa Aiba; Akira Satoh; Masahiro Nagata; Hiroyoshi Tode, all of Tokyo, Japan

[73] Assignee: Kyocera Corporation, Kyoto, Japan

[21] Appl. No.: 16,038

[22] Filed: Feb. 10, 1993

Related U.S. Application Data

[63] Continuation-in-part of Ser. No. 797,322, Nov. 25, 1991.

[30] Foreign Application Priority Data

| | | | |
|---|---|---|---|
| Feb. 28, 1992 | [JP] | Japan | 4-078227 |
| Feb. 28, 1992 | [JP] | Japan | 4-078229 |
| Mar. 31, 1992 | [JP] | Japan | 4-104008 |
| Mar. 31, 1992 | [JP] | Japan | 4-104013 |
| Nov. 30, 1992 | [JP] | Japan | 4-343503 |

[51] Int. Cl.[6] ..... G01D 15/14

[52] U.S. Cl. ..... 347/129; 347/138; 347/139; 347/140

[58] Field of Search ..... 358/302; 346/108, 346/160, 155; 355/245, 251, 270, 246; 347/129, 138, 139, 140

[56] References Cited

U.S. PATENT DOCUMENTS

| | | | |
|---|---|---|---|
| 4,600,295 | 7/1986 | Suzuki | 355/245 |
| 4,717,999 | 1/1988 | Kaneko | 346/160 |
| 4,797,335 | 1/1989 | Hiratsuka et al. | 355/251 |
| 4,804,994 | 2/1989 | Sasaki et al. | 355/245 |
| 4,851,926 | 7/1989 | Ishikawa | 358/300 |
| 4,882,252 | 11/1989 | Kawamura et al. | 430/58 |
| 5,080,988 | 1/1992 | Germain et al. | 430/54 |
| 5,111,235 | 5/1992 | Ueno et al. | 355/246 |
| 5,157,443 | 10/1992 | Anderson et al. | 355/256 |
| 5,187,523 | 2/1993 | Osawa | 430/35 |
| 5,202,730 | 4/1993 | Fuji et al. | 355/251 |
| 5,307,089 | 4/1994 | Takasu et al. | 346/107 R |

*Primary Examiner*—Peter S. Wong
*Assistant Examiner*—Randy W. Gibson
*Attorney, Agent, or Firm*—Spensley Horn Jubas & Lubitz

[57] ABSTRACT

An image forming apparatus is disclosed, in which a photo-sensitive member is exposed by exposure means accommodated therein, and development is done substantially simultaneously with the exposure.

Three time elements, that is, charging time constant C, i.e., time until reaching of a predetermined charging potential on of the photo-sensitive member in a brushing contact region between the photo-sensitive member and a toner holder after the start of charging, exposure time constant R, i.e., time until the charging potential is attenuated by the exposure to a latent image potential, and development time or time T, during which the photo-sensitive member passes by the brushing contact region, are appropriately determined.

It is found that more satisfactory image formation is possible by setting C, R and T such as to meet relations $$C+R<T \quad (1)$$

and $$C<R \quad (2)$$

At this time, the exposure position is suitably set downstream from the center position of the brushing contact region in the direction of movement of the photo-sensitive member while setting the maximum passage time T max to be $$T\ max<2C+R \quad (3)$$

Doing so is suitable for preventing re-charging of the photo-sensitive member after the exposure due to the brushing contact region and more reliable prevention of the toner separation after the development.

22 Claims, 13 Drawing Sheets

FIG. 3 (AA)
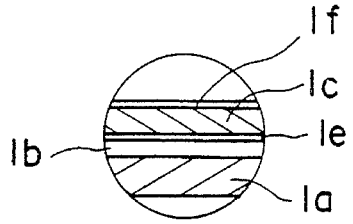
FIG. 3 (A)
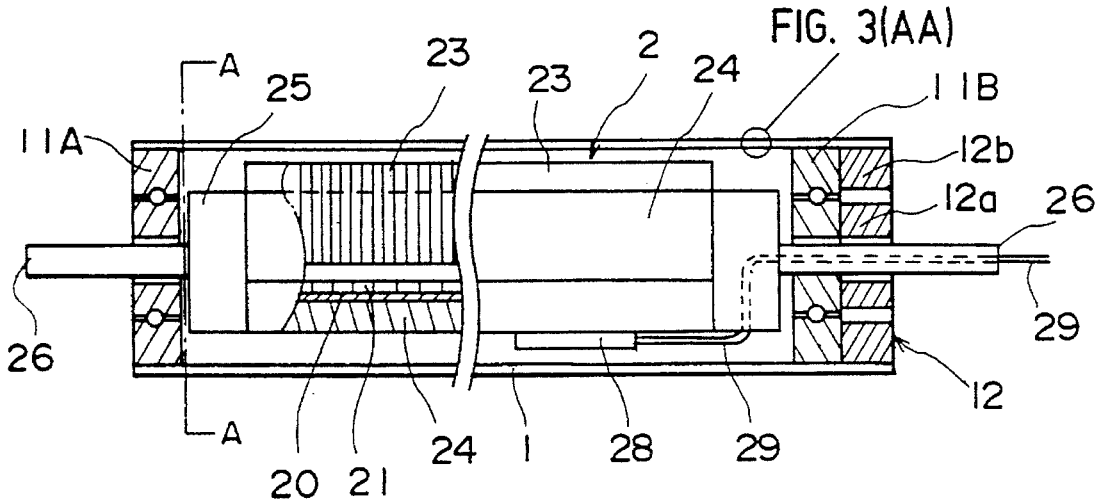
FIG. 3 (B)
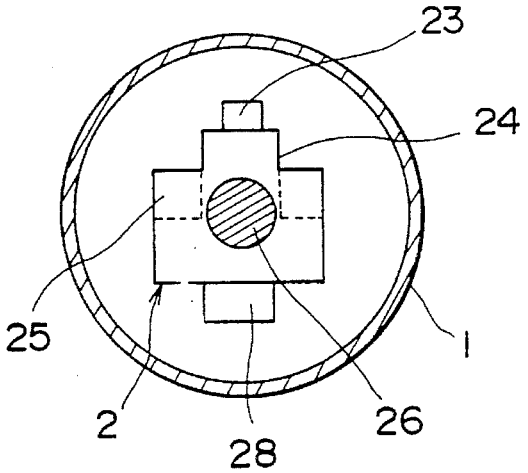

FIG. 7 (A)
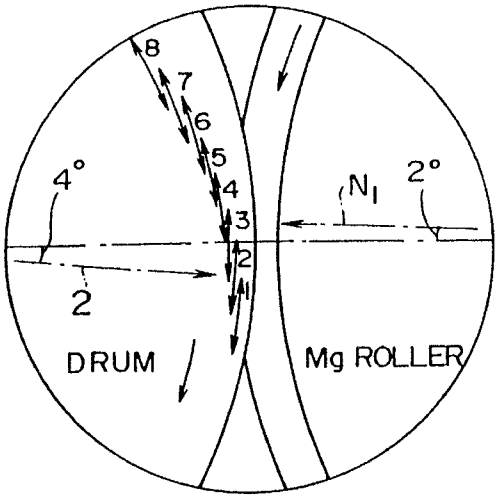
FIG. 7 (B)
| | DEVELOPMENT GAP m/m | EXPOSURE DOWN-STREAM NIP WIDTH m/m |
|---|---|---|
| ---- | 0.4 | 1.68 |
| —— | 0.45 | 1.57 |
| —·—·— | 0.5 | 1.75 |
| —·—·— | 0.55 | 1.53 |
| —— | 0.6 | 1.27 |
FIG. 7 (C)
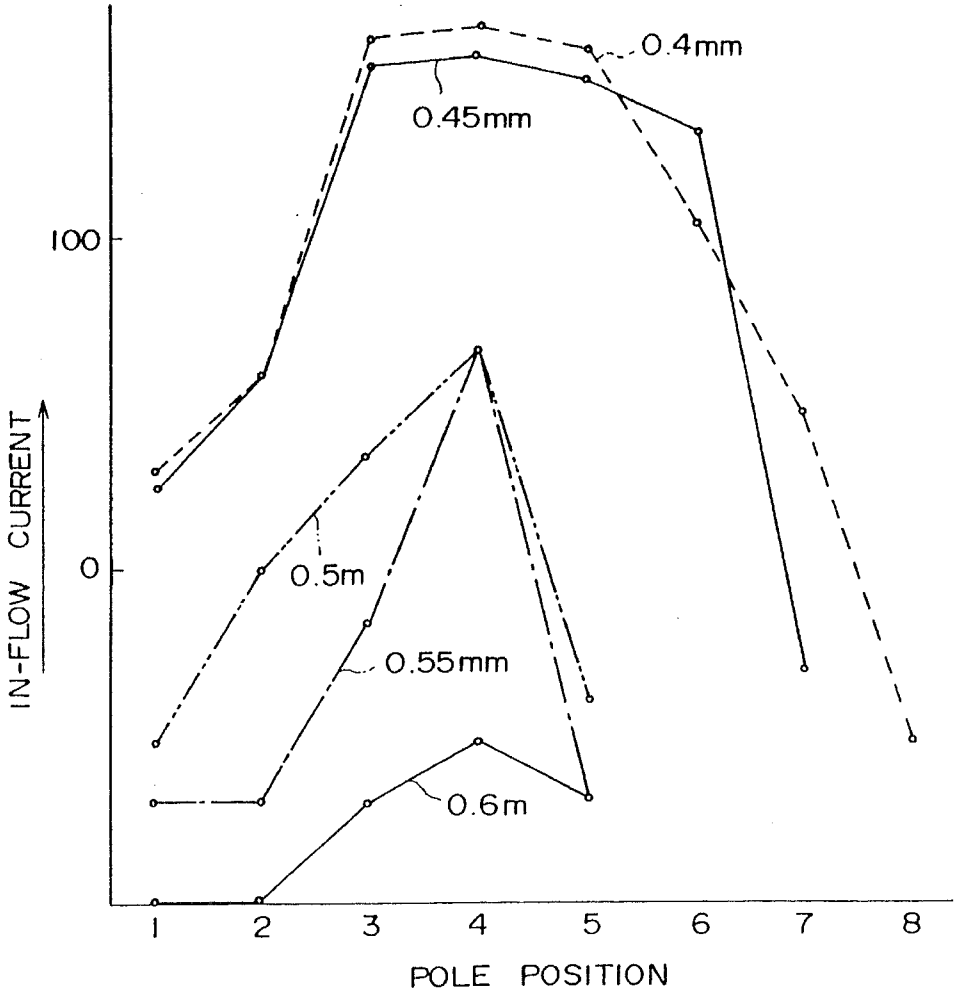

IMAGE FORMING APPARATUS AND METHOD FOR OBTAINING SMOOTH CHARGING, EXPOSURE AND DEVELOPMENT

This is a continuation-in-part application of U.S. patent application Ser. No. 07/797,322 filed on Nov. 25, 1991.

BACKGROUND OF THE INVENTION

1. Field of the Invention

This invention relates to an image forming apparatus based on electrophotographic process applied to printers, facsimile apparatuses, copiers and so forth and, more particularly, to an image forming apparatus, which comprising a drum-like or belt-like photo-sensitive member accommodating exposure means, and in which the development is effected substantially simultaneously with the exposure of the photosensitive member with the exposure means.

2. Description of the Prior Art

Heretofore, a commonly termed Carlson process electrophotographic apparatus is well known, in which various processmeans for exposure, development, transfer, cleaning (i.e., removal of residual toner), discharging and charging are disposed around the outer periphery of a photo-sensitive drum for performing image formation in a predetermined electro-photo-graphic process.

In such apparatus, however, the individual process means have to be disposed independently around the photo-sensitive drum outer periphery. In addition, high voltage is required not only for the charging of the photo-sensitive member but also as a development bias, thus inevitably complicating and increasing the scale of the construction.

To overcome these drawbacks, there has been proposed an image forming apparatus (disclosed in, for instance, Japanese Laid Open Provisional Patent Application No. 153957/83), which comprises a photo-sensitive drum formed by alamination of a transparent conductive layer and a photoconductive layer on the cylindrical transparent support and accommodating exposure means for generating an optical output in correspondence to image information. The optical output of the exposure means is focused through a convergence lens to effect exposure of the above photo-conductive layer and latent image formation thereon. Simultaneously with or soon after the exposure, the latent image is developed into a toner image with a toner support member facing the photo-sensitive drum, the toner image being then transferred onto recording paper by a transfer roller or like transfer means.

This type of image forming apparatus usually employs variuos proposed exposure means. One such exposure means (as disclosed in Japanese Laid Open Provisional Patent Application No. 14283/88) used a LED head, in which a large number of LED elements are arranged in a row extending in the axial direction of the drum and selectively turned on in corresponding to image information. Another exposure means (as disclosed in Japanese Laid Open Provisional Patent Application No. 280773/87) uses a liquid crystal head, which has a liquid crystal shutter disposed between a light source and a convergence lens and on-off controlled to form an exposure image. A further exposure means (as disclosed in Japanese Laid Open Provisional Patent Application No. 280773/87) adopts a technique of using an electroluminescence head, which has a group of electroluminescence elements arranged in a row.

With the above structure, in which the LED unit is accommodated as the exposure means in the drum, it has been impossible to provide an apparatus using a photosensitive drum having a diameter of 50 ϕ or below, particularly 40 ϕ or below. With recent development of small width LED head array, however, it has been made possible to provide an apparatus using a photo-sensitive drum with a diameter of 40 ϕ or below, more suitably 30 ϕ or below.

In such apparatus, however, a brushing contact region is formed in a zone, in which the photo-sensitive drum and a development sleeve face each other, and the three process steps of charging, exposure and development are effected on a drum portion corresponding in position to brushing contact region. Therefore, with the reduction of the diameter of the drum and sleeve the brushing contact region is reduced proportionally, making it difficult to obtain the charging, exposure and development smoothly.

With reducing drum diameter the angle of the wedge-like spaces formed on the opposite sides of the position, at which the drum and sleeve are closest to each other, is increased, thus making the brushing contact region to be correspondingly narrower. In addition, since the toner layer carried on the development sleeve has small thickness, the more the angle of the wedge-like spaces, the more it is difficult to form the brushing contact region accurately, that is, the nip width and the toner density are the more unstable.

Particularly, with reducing drum diameter the line drum speed has to be increased in a geometrical series fashion in inverse proportion to the drum diameter in order to obtain a paper feed speed, which satisfies the function of a printer or a facsimile apparatus producing 10 or 6 A-4 size prints per minute. Increasing the line drum speed leads to increased unstability of the brushing contact region, and unstable and narrow brushing contact region has direct adverse effects on the toner density and sharpness and stability of the image formation.

In the meantime, the toner used for the apparatus described above has to be a conductive toner because charge injection is made from the side of the development sleeve. Using a conductive toner, however, the efficiency of transfer of toner image onto paper is inferior.

To overcome this drawback, it is suitable to use insulating toner rather than conductive toner for the developer. In the case of using the insulating toner, however, it is impossible to carry out a charging step of causing charge injection from the development bias, and frictional charging is the sole resort. Therefore, it is difficult to obtain smooth charging.

To obviate this difficulty, a technique (disclosed in Japanese Laid Open Provisional Patent Application No. 214781/88) has been proposed, which uses a blend toner obtained by mixing a conductive magnetic toner with a resistivity of $10^4$ to $10^9$ Ω.cm and a frictional charging type high resistivity toner with a resistivity of $10^{14}$ Ω.cm or above and capable of being charged to have a predetermined number of poles by frictional charging, the resistivity of the blend toner being set to $10^5$ to $10^{10}$ Ω.cm.

However, even though the resistivity of the above conductive toner is in a semiconductive range of $10^4$ to $10^9$ Ω.cm, or the resistivity of the blend toner is again in a semiconductive range of $10^5$ to $10^{10}$ Ω.cm, with such semi-conductive range materials, the resistivity is generally varied depending on the electric field intensity and increases exponentially with reducing electric field.

Therefore, even when a developer with the resistivity in a semiconductive range of $10^5$ to $10^{10}$ Ω.cm, for instance, is used, with the charging of the photo-sensitive member up to the neighborhood of the development applied voltage, the developer present in the development space becomes high resistivity developer. In this case, smooth injection of charge into the photo-sensitive member, i.e., charging, can not be obtained.

This means that with the use of the above semiconductive range toner, of either non-blend or blend type, it is impossible to provide enough charge for sufficient erasing of the preceding image at the time of the re-charging. This results, in the subsequent development step, in a ghost generation due to history (or preceding latent image) formed by the exposure to image or a fog due to lack of the re-charging of the photo-sensitive member.

The above drawback due to a sudden increase of the developer resistivity in a low electric field range, is more pronounced in the case of using a photo-sensitive member of a-Si or like material, the resistivity of which is low compared to the conventional OPC or other organic semiconductors. Particularly, with the photo-sensitive member using a-Si, the resistivity of which is low compared to the above semiconductor range developers, the charging defectiveness is enhanced to cause readier generation of the fog or ghost.

SUMMARY OF THE INVENTION

An object of the invention is to provide an image forming apparatus, which permits a predetermined development density and sharpness of image formation to be attained even if the paper feed speed is increased along with the photo-sensitive drum diameter reduction.

Another object of the invention is to provide an image forming apparatus, which is used with a multiple component developer comprising a combination of toner and carrier and permits high image quality to be obtained without any fog.

A further object of the invention is to provide a back side exposure development method, which can preclude ghost or fog that are otherwise resulting from sudden developer resistivity increase in a low electric field range and permits clear image formation even with an a-Si photo-sensitive member.

A still further object of the invention is to provide an image forming apparatus, which permits high image quality free from fog to be obtained when producing color image as well.

The invention will now be described in a sequential manner.

As described before, by increasing the paper feed speed, i.e., the line speed of the photo-sensitive drum, while reducing the diameter thereof, the nip width in the frictional zone (i.e., frictional zone width) is reduced. It is thus necessary to permit a predetermined charging potential to be obtained even where the charging time in the brushing contact region is reduced.

Even where the charging time in the brushing contact region is reduced, it is possible to provide a predetermined charging potential by means of reducing the resistance of the developer to be in frictional contact with the photo-sensitive drum or reducing the electrostatic capacitance thereof. With this structure, since the exposure after the charging is effected on a drum portion present in the brushing contact region, re-charging is readily caused after the exposure and development, resulting in disturbance of the image or fog. This is undesired from the standpoint of the improvement of the image quality.

Accordingly, in the case of setting a short charging time to set a small nip width as noted above, by appropriately determining the relationship of the charging time, exposure time and development time to the drum speed, it is possible to prevent the re-charging and obtain smooth charging, exposure and development.

According to the invention, the above three time elements are related to one another in relation to the friction time.

More specifically, the invention is based on a finding that it is possible to obtain satisfactory image formation by setting relations $$C+R<T \tag{1}$$

and $$C>R \tag{2}$$

where C represents a charging time constant, i.e., a time reaching of a pre-determined potential of charging by the photo-sensitive member in the brushing contact region after the start of the charging, R represents an exposure time constant, i.e., a time until the charging potential noted above is attenuated by the exposure to a latent image potential level, and T represents a time, in which the photo-sensitive member passes by the brushing contact region. Of course this setting of relations applies not only to the photo-sensitive drum but also to a belt-like photo-sensitive member.

The above relations mean that it is necessary to set the time T, in which the photo-sensitive member passes by the brushing contact region, to be greater than the sum of C and R for obtaining satisfactory and smooth charging and exposure, and unless the charging time constant C is set to be greater than the exposure time constant R, the re-charging after the exposure is liable, leading to fog or sharpness reduction of the image.

In this case, the exposure position is suitably set downstream from the center position of the brushing contact region in the direction of movement of the photo-sensitive member, as mentioned before. In addition, the maximum time T max, in which the photo-sensitive member passes by the brushing contact region, is suitably set to be no greater than (2C+R). By so doing, it is possible to prevent the re-charging in the brushing contact region after the exposure and ensure increased reliability of prevention of the toner separation after the development. This relation is given as $$T<2C+R \tag{3}$$

In other words, the maximum passage time T max should not exceed the sum of the charging time C, exposure time R and re-charging time, and the re-charging time does not exceed the charging time C. Consequently, we have $T<C+R+C$. By rearranging this relation, the relation (3) is obtained.

As is obvious from this relation, by setting the exposure position in the brushing contact region to be downstream from the mid position of the brushing contact region in the direction of movement of the photo-sensitive region, it is possible to preclude the above drawback even if the re-charging takes place after the exposure and development. This is so because the re-charging time until the reaching of the last end of the brushing contact region can be made short or substantially zero. However, where sole conductive toner is used for the development, it is difficult to meet the relation (2) of C>R.

In addition, re-charging is caused quickly through toner due to re-injection of charge at the exposed surface.

Further, unlike the case of using an insulating toner, it is impossible to effect transfer of toner image after the development to ordinary paper by using electostatic transfer means based on corona discharge. Therefore, it is usual to use a transfer roller and apply a transfer bias or the like to the transfer roller for improving the transfer efficiency. However, the resistance of the recording paper sheet is readily varied depending on the relative humidity and other environmental factors. This interferes with stable and smooth transfer and makes it difficult to obtain high quality image formation.

To obviate this difficiency, it is suitable to use a developer, which comprises a carrier made conductive at least on the surface and a high resistivity or insulating toner, more preferably as a developer comprising a conductive magnetic carrier, which is formed by securing a conductive resin to the surface of mother particles or insulated ferrite particles obtained by dispersing a magnetic material in an insulating resin as a conductive carrier.

In this case, it is possible to incorporate a high resistivity carrier in addition to the conductive carrier as will be described later.

Thus, according to the invention, while it is possible to obtain stable and smooth transfer by using a high resistivity or insulating toner, by using a conductive carrier for charge injection, it is possible to set a high carrier conductivity independently of the transfer side, thus permitting reduction of the charging time.

To obtain a predetermined image density in this case, the high resistivity or insulating toner is set to substantially 10 to 20% compared to the conductive carrier.

Further, the use of the carrier, which is not entirely conductive but is conductive only on the surface and highly resistive or insulating in the inside, is suitable in that the electrostatic capacitance can be increased.

More specifically, with conductive fine particles attached to the carrier surface, it is possible to maintain the conductivity irrespective of the inner material constitution of the carrier to permit charging and exposure to be obtained stably. Further, since a magnetic material is dispersed in the binder, it is possible to provide a strong magnetic property, which is suitable for smooth formation of the brushing contact region developer (i.e., a toner pool).

To maintain the conductivity, the average size of the carrier is suitably set to 1 to 5 times the average size of the toner.

If the average size is more than five times, the resistance of the developer is increased, and the capacity of providing charge to the photo-sensitive member is reduced. If the average size is less than one time, on the other hand, carrier separation to be described later takes place to adversely affect the image. In addition, the fluidity is unsatisfactory.

Further, it is possible to maintain the conductivity by increasing the content of small size carrier component in the carrier size distribution.

The carrier is a phenomenon that the small size component of the carrier noted above is attached to the latent image position of the photo-sensitive drum together with insulating toner and is thus separated from the brushing contact region. The carrier separation is made up for by replenishing with corresponding flesh for maintaining the conductivity.

In this case, if the small size carrier that is separated is a resin carrier having the same color as the toner and being thermally fusible in the fixing process, it can be dealt with in the same way as the toner without any adverse effect on the image quality.

The charging time may be reduced suitably by reducing the electrostatic capacitance of the photo-sensitive drum as noted above. Specifically, a-Si type materials are suitably used for the photo-sensitive member.

The a-Si type photo-conductive layer, compared to the other photo-conductive materials such as SeAs, SeTe, CdS and OPC, has high capacities of light absorption and photo-carrier generation. Besides, the mobility of the generated photo-carriers is high. Thus, it is possible to obtain photo-electric conversion.

Further, by using the a-Si type material for the photo-conductive layer and forming the conductive layer to be a thin layer, specifically with a thickness of 2 to 17 μm determined from the consideration of the light absorption efficiency, it is possible to reduce the electrostatic of the photo-sensitive drum while ensuring smooth charging thereof.

The exposure means is usually suitably constructed as a LED head, which comprises a group of LED elements arranged in a row extending in the main scanning direction of the photo-sensitive member and driven for exposure by time division driving for every n bits as a unit, or as a LED head, which comprises a group of LED elements arranged in the main scanning direction of the photo-sensitive member and driven for exposure by static driving for every scan row unit.

The applicant has earlier proposed, in a parent application, an attempt of setting the direction of movement of the photo-sensitive member in the brushing contact region to be opposite to the toner conveyance direction. In this case, where a photo-sensitive drum and a development sleeve are used, the direction of their rotation is set to be the same, i.e., either clockwise or counterclockwise. By so doing, it is possible to set opposite directions of their movement in the brushing contact direction. This arrangement is herein-after referred to as "counter feed". With the counter feed, it is possible to increase the amount of toner supplied to the brushing contact region, i.e., increase the toner density, thus permitting charging efficiency increase in a short period of time.

However, in the apparatus using a photo-sensitive drum and a development sleeve, the brushing contact region is formed between the drum and the sleeve, and their closest portions function just like a dam to cause accumulation of much toner in a portion of the brushing contact region on the toner inlet side corresponding to the downstream drum portion. The toner density is thus high in this portion, while it is low in the portion upstream the dam. That is, a sufficiently high toner density can be obtained in the upstream portion of the brushing contact region in the direction of the drum rotation. Therefore, the intended effect can not be expected at all times.

In order to overcome this drawback, the inventor conducted researched and investigations and found that the toner density in the portion of the brushing contact region upstream the dam can be desirably increased with an arrangement that, instead of the counter feed of the photo-sensitive drum and the development sleeve, the movement directions thereof in the brushing contact region are set to the forward direction, that is, they are fed forward, while setting a higher line speed of the development sleeve than that of the drum.

In this case, the line speed of the sleeve is suitably set to 5 to 10 times to the line speed of the drum. If it is lower than 5 times, sufficient charging by brushing can not be obtained, thus resulting in charging defectiveness and generation of the ghost or image density.

If the line speed of the sleeve is higher than 10 times, contamination of the apparatus inside and reduction of the life of the developer result from increase of the relative brushing speed. Particularly, with the relative brushing speed increase, the development nip (on the side of the downstream end of the brushing contact region) is liable to become unstable after the exposure.

With the setting of the line speed of the sleeve to be higher than the drum line speed as above, a toner density increase in the brushing contact region and can be obtained to increase the charging efficiency.

However, the toner density increases poses a problem of re-charging at the time of the exposure and development. This disables the attainment of the smooth action according to the invention.

Accordingly, according to the invention the toner density is made sufficiently high in the charging region and relatively low in the region of the exposure and development, thus effectively solving the above problem.

More specifically, this is attained by setting the position of exposure by the exposure means to be downstream the dam in the direction of the drum rotation.

To further increase the development density on the charging region side, it is possible to set the principal pole of the magnet assembly in the development sleeve upstream the exposure position.

In this case, it is possible to use any developer. Particularly, as mentioned before, by using a multiple component carrier comprising a combination of one or more carriers including a conductive carrier and a high resistivity or insulating toner, it is possible to obtain smooth charging in the charging region owing to the conductive carrier or carriers, while preventing re-charging of the areas, to which the insulating toner is attached by the exposure and development, from the top surface of the areas, thus permitting smooth exposure and development.

With the above construction, it is possible to reduce the diameter of the photo-sensitive drum while maintaining a predetermined paper feed speed. However, in order to provide for a sufficient toner density in the charging region and a comparatively low toner density in the exposure and development region, it is suitable to set the development gap at the position of the closest portions of the drum and sleeve to each other to 0.3 to 0.55 mm.

When it is intended to reduce the drum diameter, particularly to be smaller than 50 ϕ, the angle of the wedge-like spaces on the opposite sides of the closet portion position noted above is increased to correspondingly make the developer brushing contact region narrow. In this case, it is difficult to obtain a nip width which can meet the relations (1) to (3). In addition, since the toner layer carried on the development sleeve is thin, the larger the wedge-like space angle is, the more it is difficult to form the brushing contact region stably and accurately.

Particularly, with reducing drum diameter the line speed of the drum has to be increased inversely proportionally in a geometrical series fashion in order to obtain a paper feed speed satisfying the function of a 10 or 6 print printer or facsimile machine. Consequently, the brushing contact region rapidly becomes more and more unstable, and the unstabilization and narrowing of the brushing contact region have adverse effects on the sharp and stable image formation.

The invention seeks to realize the most suitable structure when the photo-sensitive drum diameter is set to 50 ϕ or below, preferably 40 ϕ or below, and it features that the diameter of the development sleeve is set to be substantially equal to or greater than the above diameter of the photo-sensitive drum.

The term "substantially equal" does not stringently mean the equality but covers diameter ratios within 10% because in this diameter ratio range the function that is obtainable is the same.

The ground for this feature is based on experiments. Basically, by setting the sleeve diameter to be substantially equal to or larger than the drum diameter, it is possible to reduce the wedge-like space angle and also obtain close control of the angular position of the stationary magnet assembly accommodated in the development sleeve.

With this feature, even by reducing the drum diameter it is possible to obtain a nip width satisfying the relations (1) to (3) to permit effective charging, exposure and development.

In the basic function according to the invention, as shown in FIG. 2, a developer, for instance comprising a high resistivity or insulating toner and a conductive carrier, is carried on a photo-sensitive drum 1, which comprises a transparent support la and a lamination thereon including a transparent conductive layer lb, a blocking layer le and a photo-sensitive layer lc/lf including a photo-conductive layer lc and a surface layer lf, and the drum 1 and sleeve 30 are rotated in the direction of arrow and with a mutual speed difference, thus forming a developer brushing contact region 10 in the form of a commonly termed magnetic brush in the development gap by utilizing the magnetic force of a stationary magnet assembly disposed in the sleeve 30.

In the brushing contact region 10, a voltage Vs applied to the development sleeve 30 from a development bias circuit causes the toner to be transferred and attached to the photo-sensitive drum 1 to form a magnetic brush of developer, which charges the drum 1 in brushing contact therewith. When the potential on the drum 1 being charged is developed up to the development bias voltage Vs, the developer is returned to the development sleeve 30 by the magnetic force of the stationary magnet assembly 33. At this time, immediately after the charging an exposure image is focused on the durum 1 with exposure means 2 accommodated in the drum 1. As a result, the potential developed by the charging is attenuated down to the vicinity of 0 V, and a phenomenon of toner inversion is brought about by the potential difference between the development bias Vs and the drum potential. In this way, it is possible to obtain predetermined image formation.

The relation between the development bias voltage Vs and potential Vh developed by the charging is represented by an equivalent circuit shown in FIG. 12.

In the Figure, Rh designates the photo-sensitive member resistance, Ch the photo-sensitive member capacitance, Rt the developer resistance, and Ct the developer capacitance. Further, Rt and Ct represent the resistance and capacitance, respectively, of the developer as a mixture of toner and carrier incorporated in predetermined proportions.

From the above equivalent circuit, a calculation formula (5) is obtained, which expresses the relation between the development bias voltage Vs and potential Vh developed by the charging.

$$Vh=Vs[(Rh/Rt+Rh)-A] \quad (5)$$

$$A=\{(Ch.Rh-Ct.Rt)/(Ct+Ch)(Rt+Rh)\}.\exp\ [-\{(Rt+Rh)t\}/\{Rt.Rh(Ct+Ch)\}]$$

t: development time.

Unless a process setting such that the resistance Rt and Rh and capacitances Ct and Ch in the formula (5) are all small and that the development time is sufficiently short, the formula (5) can be approximated as $$Vh=Vs(Rh/Rt+Rh). \quad (6)$$

FIG. 13 shows a development γ characteristic, i.e., the relation between the image density and the development bias voltage Vs minus the photo-sensitive member potential Vh developed by the charging. It is shown that by effecting the exposure when Vc is exceeded by (Vs–Vh) with the build-up of the potential of the photo-sensitive member in the brushing contact region by the charging of the member with the development bias, the development is attached to non-charged exposed portions so that smooth inverse development can be obtained.

FIG. 11 shows the relation between the charging potential Vh and the developer resistance Rt.

The solid curve is in the case of the resistance of the photo-sensitive member exposed to image (i.e., bright resistance), and the dashed curve is in the case of the resistance of the member not exposed (i.e., dark resistance). These curves can serve as measures of the ghost and fog.

When the development start voltage Vc (i.e., voltage capable of development) is exceeded (corresponding to the shaded portion in the Figure), ghost and fog are generated in the case of the former curve, and fog is generated in the case of the latter curve.

Thus, it is seen from FIG. 11 that the resistance of the developer may be set to a value such that the photo-sensitive member can be charged to at least above the voltage Vc capable of development.

The dark resistance of the photo-sensitive member, on the other hand , is equal to or above the bright resistance at all times, that is, the former is never lower than the latter. Thus, the former may be set to be equal to the latter. Further, the term of A in the formula (5) can be perfectly ignored under the normal condition, particularly with an a-Si photo-sensitive member. Thus, by setting the resistance of the developer such as noted above, it is possible to preclude the generation of the ghost and fog.

$$Vh=Vs-Vc<Vs(Rh/Rt+Rh) \quad (6')$$

By developing the relation (6') we obtain $$Rt<(Vc/Vs-Vc)Rh \quad (4)$$

Rt: resistance of the developer (when the development voltage Vc is applied).

Vs: development bias (voltage) applied to the developer carrier.

Vc: development voltage (i.e., development bias minus photo-sensitive member potential by charging when the inverse development is started).

Rh: bright resistance of the photp-sensitive member.

According to the invention the resistance of the developer may thus be set not independently but such that it is lower than the resistance value determined by the relation (4) at the time of the development. In other words, even when the developer is deteriorated as a result of the repeating of the brushing contact charging of the photo-sensitive member in the brushing contact region or the stirring of the developer, it is possible to obtain development such that the resistance of the deteriorated developer is in a range satisfying the formula (6').

FIG. 14 shows the electric field dependency of the resistance of the developer in case of using a two-component developer as will be described later. Curve (A) shows the electric field dependency of the developer in an initial stage of development. Curve (B) shows the dependency after obtaining a predetermined number of (for instance 15,000) prints. In either case, it is shown that the resistance is high in low electric field range and that the resistance of the developer is increased with the deterioration thereof.

Therefore, even when the developer is deteriorated due to the repeating of the brushing contact charging of the photo-sensitive member in the brushing contact region or stirring of the developer, it is necessary to effect development in the range of the resistance of the deteriorated developer satisfying the formula (1).

The resistance increase of the two-component developer due to deterioration thereof is thought to be due to the resistance increase of the carrier because the toner is intrinsically an insulator.

According to the earlier patent application, the developer is prepared such that the carrier, when deteriorated to be insulating, is permitted to be attached together with a substantially insulating toner to latent image areas of the photo-sensitive drum and separated from the brushing contact region to let flesh carrier to be supplied at all times.

Such arrangement, however, is based on the carrier separation, and therefore color and other applications of the arrangement are difficult.

The inventor has accordingly proposed in the earlier application technique to use a three-component developer, which in corporates a high resistivity or insulating carrier together with the conductive resin carrier noted above (Japanese Patent Application No. 10513/92).

However, when the high resistivity carrier is incorporated, electrostatic attraction takes place between the carrier and the insulating toner, and the toner is attracted to the high resistivity carrier. In consequence, the amount of toner around the conductive carrier is decreased to increase the probability of contact of conductive carrier particles with one another.

With the high probability of contact of conductive carrier particles with one another, electric path can be readily secured, even when minute conductive particles having been attached to the conductive resin carrier surface are separated and damaged, and thus it is possible to obtain stable resistance for long time.

With the three-component developer noted above, the insulating toner can be held by the electrostatic forces of the high resistivity carrier. It is thus possible for the toner to be carried on the development sleeve and transferred to the photo-sensitive member without any magnetic force provided to the toner itself. This means that the toner can be used as color toner and also that the invention is applicable to color image forming apparatus.

More specifically, the magnetic material is generally non-transparent, and by incorporating a magnetic component in the toner, a sharp color can not be obtained. It is possible to use transparent magnetic powder such as YIG (yttrium/indium/gallium) as a color toner. However, such magnetic powder is expensive and therefore uneconomical as the toner, which is a consumable product. Thus, for the color image formation it is necessary to be able to use non-magnetic toners.

The non-magnetic toner, however, is held by the sole brushing contact charging of the high resistivity carrier. Therefore, it is transferred and carried by weak forces compared to the magnetic forces of attraction. Besides, with the apparatus according to the invention the charging and exposure are effected while the developer is stirred in the developer pool noted above due to the line speed ratio between the development sleeve and photo-sensitive drum. Therefore, the non-magnetic toner is provided with electromagnetic force of retention and is attached to the background areas of the photo-sensitive member as well due to the brushing contact therewith, thus generating a fog.

According to the invention, use is made of a developer, which is composed of one or more magnetic carriers and a high resistivity or insulating toner, more specifically composed of a conductive magnetic carrier, a high resistivity or insulating carrier (hereinafter referred to as high resistivity carrier) and an insulating non-magnetic toner (hereinafter referred to as toner), while using a bias having an oscillating waveform, which is substantially centered on the photo-sensitive member charging potential and has the lowest voltage level set to be that charging potential or above, the bias being applied as the development bias between the development sleeve and the photo-sensitive drum via the brushing contact region.

In this case, the charging potential level is set by the center voltage level of the development bias, so that the two voltages are substantially identical although they may not be perfectly equal due to slight voltage drop caused by the developer.

Such oscillating waveform bias is obtained by superimposing a sine wave, a triangular wave or a rectangular wave, preferably a rectangular wave, on DC current corresponding to the charging potential level.

The term "conductive" noted above refers to the resistivity of $10^6\Omega$.cm or below, preferably $10^4\Omega$.cm or below, and the term "high resistivity or insulating" refers to the resistivity of $10^9\Omega$.cm or above, preferably $10^{11}\Omega$.cm or above.

The apparatus according to the invention adopts an inverse development system, in which toner is attached to exposed areas of the photo-sensitive member. This means that the background areas are at the charging potential, while image areas are at the exposure potential.

The force acting on the toner at the time of the development is the resultant of electrostatic force Fe, magnetic force Fm, mechanical force F and centrifugal force Fr.

In the background areas, the electrostatic force Fe is ideally zero, and it may be made to be approximately zero by making the charging systems of the toner and photo-sensitive member closer.

When there holds a relation $$Fe+Fr<Fm+F$$

the toner is not transferred to the photo-sensitive drum. In the case of using a non-magnetic toner, however, if the line speed of the development sleeve is set to be considerably higher than the line speed of the photo-sensitive drum, it increases the possibility of the transfer of the toner to the background areas due to the centrifugal force produced by the line speed difference (because of the mechanical force F is negligeably low) because Fm=0.

In the Carlson type electrophotography, by setting the development bias Vb to be $|Sp|>|Vb|$ with respect to background area surface potential Sp, it is possible to apply an electric field force Fn for pulling back the toner attached to the background aeas, thus preventing the fog. However, in the system such as the apparatus according to the invention, in which the photo-sensitive drum is charged while applying the development bias between the development sleeve and the drum via the brushing contact region formed between the two, it is impossible with the DC development bias to set $|Sp|>|Vp|$ for setting the charging potential level with the development bias potential due to some voltage drop caused by the developer.

According to the invention, the oscillating waveform noted above is superimposed on the DC bias having the potential level corresponding to the charging potential, thus momentarily realizing the above formula and alleviating the fog.

In this case, there is no possibility of separation to the image areas because the minimum potential level of the oscillating waveform is above the exposure potential on the photo-sensitive drum. It is thus possible to obtain sharp image formation without image density reduction.

Among the oscillating waveforms are sine wave, triangular wave, rectangular wave and pulse wave having an amplitude with respect to the ground potential. With the sine and triangular waves, however, an electric field sufficient to cause movement of the toner can not be reached because the top of the potential is a point. Therefore these waves are insufficient although they have some effects.

With a pulse wave, it is impossible to supply sufficient charge for the charging, and therefore, the sharpness of image is reduced.

With a rectangular wave, it is possible to provide for inverse transfer of toner attached to the background areas by causing oscillation of the toner with the centrifugal force Fr noted above, thus smoothly preventing the generation of the fog.

The frequency of the oscillating waveform bias used according to the invention suitably satisfies an equation (7) below and is 1,000 Hz or below, preferably 50 to 750 Hz.

$$Hmin=1/(Sd/Nw) \quad (7)$$

Hmin: minimum development bias frequency.

Sd: line photo-sensitive drum speed.

Nw: nip width downstream the exposure position of the brushing contact region in the direction of the drum rotation.

For providing the oscillation, it is necessary for the bias to complete at least one reciprocation over the nip width downstream from the exposure position in the direction of the drum rotation. Otherwise, horizontal streaks will be generated on the photo-sensitive drum due to transfer of toner only in one direction or the other.

Conversely, the function according to the invention turns to be reduced when the frequency exceeds 600 Hz, and when the frequency exceeds 1,000 Hz, the pulse width sufficient for causing the oscillation of the toner can no longer be obtained, thus disabling the prevention of the fog generation, as made obvious from the results of experiments to be described later.

Therefore, the frequency is suitably 50 to 750 Hz, although it depends on the line speed of the photo-sensitive drum.

As for the amplitude of the oscillating waveform bias, it is too small, the obtainable effect is only the same as in the case of the DC bias. If it is excessive, on the other hand, sufficient charging is caused, thus reducing the image sharpness.

According to the invention, the amplitude is suitably in a range of 15 to 60% of the charging potential on the photo-sensitive drum.

According to the invention, it is suitable to reciprocal oscillation of the sole toner by the bias noted above. For this reason, according to the invention it is suitable to have the two carriers noted above as magnetic carriers and set the weight ratio between the carriers and toner to 4 or above versus 1.

By providing magnetic carriers as the two carriers, it is possible to obtain magnetic retaining force on the side of the development sleeve for preventing the attachment of the two carriers to the photo-sensitive drum. In addition, the effect of prevention of the attachment noted above can be reinforced by setting the weight ratio of the toner to the carriers to 1 to 4 or above.

BRIEF DESCRIPTION OF THE DRAWINGS

FIGS. 3(A) and 3(AA) show a partly broken-away axial sectional view of a drum unit comprising a photosensitive drum and an exposure head assembled therein. FIG. 3(B) shows a section taken along line A—A in FIG. 3(A);

FIG. 7(A)–7(C) are three graphs showing currents in various regions as substituent characteristics for development gap, development nip width and development density;

DETAILED DESCRIPTION OF THE PREFERRED EMBODIMENT

Now, an embodiment of the invention will be described in detail with reference to the drawings. Unless otherwise stated, the size, material, shape and disposition of the components described are by no means limitative and are construed to be illustrative only.

Figure 1:
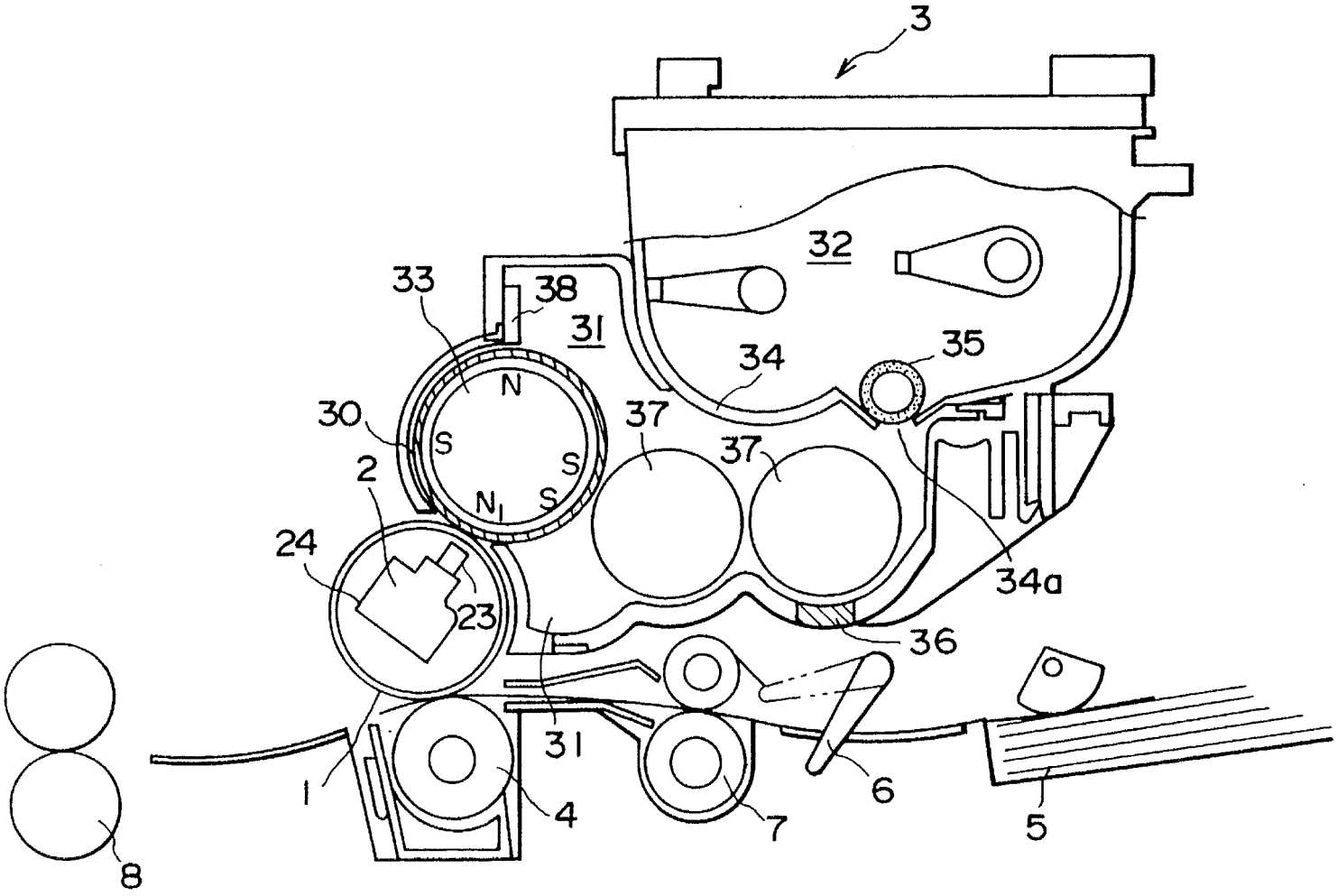
FIG. 1 is a schematic view showing an embodiment of the image forming apparatus according to the invention.

FIG. 1 is a schematic view showing a printer embodying the invention.

Designated at 1 is a photo-sensitive drum, in which a LED unit 2 is accommodated. A development sleeve 30 assembled in a development unit 3 and a transfer roller 4 are disposed around the photo-sensitive drum 1 in the rotational direction thereof. In the tangential direction between the photo-sensitive drum 1 and transfer roller 4, a paper feed cassette 5, a paper sensor 6, a resist roller 7, the transfer roller 4 and fixing rollers 8 are disposed in the mentioned order from the upstream side.

The development unit 3 includes a toner source 32 and a vessel 31 accommodating toner and carrier. A development sleeve 30 accommodating a stationary magnet assembly 33 is disposed on the side of the vessel 31 facing the photo-sensitive drum 1. The sleeve 30 has a diameter of 30ϕ, which is the same as the diameter of the drum 1. It is rotated in the counterclockwise direction, i.e., a direction opposite to the direction of rotation of the drum 1. Suitably, it is rotated at 5 to 10 times the line speed of the drum 1 to permit the forward feed.

The toner source 32 and vessel 31 are defined by a partitioning wall 34. A toner replenishment roller 35 is disposed in the toner source 32 adjacent a slit opening 34*a* formed in a central portion of the partitioning member 34. According to a signal provided from a density sensor 36 in response to the reduction of the toner density, i.e., the ratio of toner to carrier, in the vessel 31, the toner replenishment roller 35 is rotated, thus maintaining the proper toner-to-carrier ratio at all times.

Paired mixers 37 are disposed in the vessel 31 to maintain uniform toner density therein.

At the outlet end of the vessel 31 upstream the development sleeve 30, a doctor blade 38 is mounted to regulate the developer led to a development position to a thin layer.

The stationary magnet assembly 33 has a pole arrangement as shown in FIG. 1. Its main pole N1, which forms the brushing contact region noted above, is located at a position of about 2 degrees upstream the position of the closest portions of the drum and sleeve to each other in the direction of the drum rotation, the field intensity of the main pole being set to 800 Gauss.

As the transfer roller 4, a conductive roller is used for increasing the transfer efficiency. The transfer roller 4 is biased with a transfer bias of the opposite polarity to the charging potential of the toner, for instance of about −300 V. It can be urged uniformly against the drum and rotated in synchronism thereto.

Figure 2:
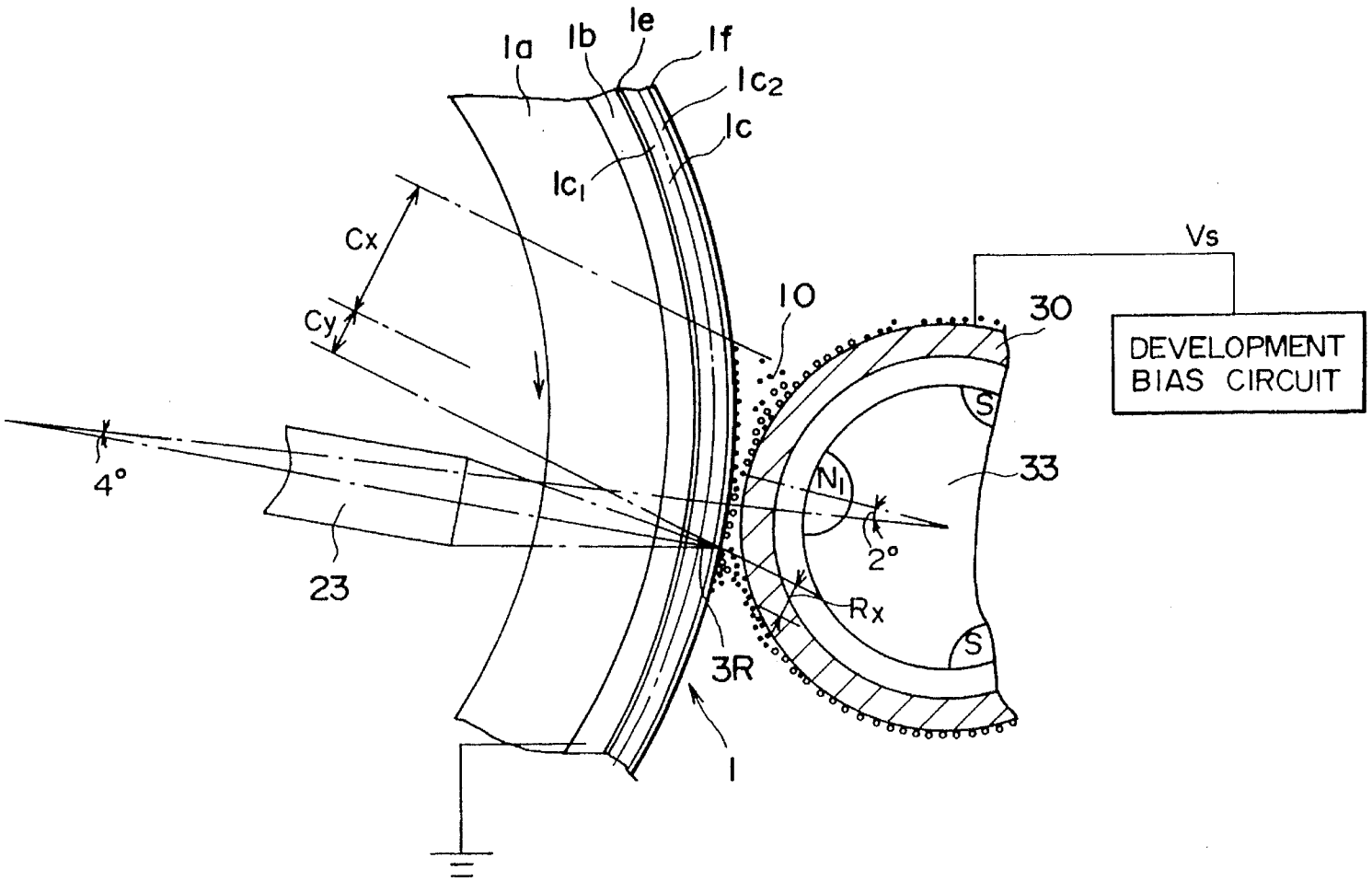
FIG. 2 is a fragmentary sectional view, to an enlarged scale, showing a portion of the apparatus in the neighborhood of a development gap, a photo-sensitive drum being shown to have a greater diameter than the actual diameter for clarifying the function according to the invention.

FIG. 2 shows, to an enlarged scale, an essential part of the image forming apparatus. To facilitate the description, the drum is shown enlarged, but actually, the drum and sleeve have the same diameter as shown in FIG. 1.

Referring to the Figure, the development sleeve 30 faces the outer periphery of the photo-sensitive drum 1 opposite a focusing position provided by the exposure head 2. The photo-sensitive drum 1 comprises a transparent support member la, on which are laminated a transparent conductive layer lb, a prevention layer le, a photoconductive layer lc and a surface layer lf, these layers being laminated in the mentioned order. The transparent support member la is made of a transparent inorganic material, e.g., glass (such as Pyrex glass, borosilicate glass, soda glass, etc.), quartz, sapphire, etc., or a transparent resin, e.g., fluorine resins, polyester, polycarbonate, polyethylene, pholyethylene telephthalate, vinylon, epoxy resins, etc. In this embodiment, it is a transparent cylindrical glass member with a wall thickness of 2 mm, an outer diameter of 30 mm and a length of 300 mm.

The transparent conductive layer lb may be made of a transparent conductive material, e.g., ITO (indium tin oxide), lead oxide, indium oxide, copper iodide, etc. Alternatively, it may be made of such metal as Al, Ni, Au, etc. such that it is as thin as is semi-transparent.

In this embodiment, an ITO layer is formed by an active reaction deposition process and to a thickness of 1,000 Angstroms on the outer surface of the glass support member.

The photoconductive layer lc, which is of a-Si type, the prevention layer le, which is of a-Si type, and the surface layer lf, may be made of the glow discharge process, the spattering process, the ECR process, the deposition process, etc. In their formation, 5 to 40% by weight of an element for the dangling bond end, e.g., hydrogen or a halogen, is suitably incorporated.

More specifically, suitably the photoconductive layer lc is made of a photoconductor composed of a-Si and H. In the case of using a positive development bias, it suitably is non-doped or contains a Va family element for increasing the electron mobility. In the case of the negative development bias, a IIIa family element is suitably incorporated to increase the hole mobility. Further, concerning such electric characteristics as dark conductivity and photoconductivity, and also the optical band gap, etc., such element as C, O, N, etc. may be incorporated, if necessary, for providing desired characteristics.

The photoconductive layer lc may en enhance the photo-sensitivity and breakdown voltage by a two-layer lamination structure having, from the back side, a photo-excitation sub-layer $lc_1$ for providing for enhanced photo-carrier generation function and a sub-layer $lc_2$ with a carrier conveying function.

In this embodiment, a-SiC injection prevention layer le, a-Si photoconductive layer lc and a-SiC surface layer lf are laminated in the mentioned order on the transparent conductive layer lb using a capacitance-coupled glow discharge decomposer. The resistivities of the prevention and surface layers le and lf are set to $10^{12}$ to $10^{13}\Omega$.cm.

The photo-excitation sub-layer $lc_1$ is formed at a low formation speed. By introducing more doping element for increasing the factor of dilution with $H_2$ or He than in the carrier conveying sub-layer, the photo-carrier generation function of the sub-layer $lc_2$ may be enhanced.

The carrier conveying sub-layer $lc_2$ may be formed in a manner inverse to the formation of the sub-layer $lc_1$. This sub-layer has the roles of increasing the breakdown voltage of the photo-sensitive drum and permitting carrier injected from the sub-layer $lc_1$ to proceed smoothly to the drum surface. Besides, in this sub-layer the carrier generation is also caused by light transmitted through the photo-excitation sub-layer, and this layer contributes to the photo-sensitivity of the photo-sensitive drum.

The photo-excitation sub-layer $lc_1$ suitably has a thickness of 0.03 to 5 μm, preferably 0.5 to 3 μm, and the carrier conveying sub-layer $lc_2$ suitably has a thickness of 0.05 to 10 μm, preferably 1 to 5 μm.

The thickness of the photoconductive layer lc, comprising the above two sub-layers, is suitably set to 2 to 17 μm from the considerations of securing necessary charging, insulation and dielectric breakdown voltage and the suppression of the absorption of the exposure light and the residual potential.

The prevention and surface layers le and lf are suitably made of an inorganic high resistivity or insulating material, e.g., a-SiC, a-SiO, a-SiN, a-SiON, a-SiCON, etc., or an organic insulating material, e.g., polyethylene telephthalate, parilene, polyethylene, polyimide, polyethylenepropyrene tetrafluoride, etc. Particularly, an a-SiC layer can enhance such characteristics as the dielectric breakdown voltage, wear resistance and environmental resistance as well as the close contact between the transparent conductive layer lb and photoconductive layer lc.

The value of x in a-$Si_1$–xCx is $0.3 \leqq x < 1.0$, preferably $0.5 \leqq x \leqq 0.95$, for obtaining high relative humidity resistance with a resistivity in a range of $10^{12}$ to $10^{13}\Omega$.cm. It is possible to provide a gradient of the content of C in the layer. It is possible to further improve the relative humidity resistance by incorporating, N, O and Ge together with C.

The prevention layer le suitably has a thickness of 0.01 to 5 μm, preferably 0.1 to 3 μm, and the surface layer lf suitably has a thickness of 0.05 to 5 μm, preferably 0.1 to 3 μm.

In the case of using an a-Si type composition for the prevention layer le, in the case of using a positive development bias it is suitably to incorporate a IIIa family element (in 1 to 10,000 ppm, preferably 100 to 5,000 ppm) for preventing the injection of electrons from the conductive layer lb, and in the case of using a negative development bias it is suitable to incorporate a Va family element (in 5,000 ppm or below, preferably 300 to 3,000 ppm). Further, the incorporation of 0.01 to 30 atomic % of O and N has an effect of further improving the close contact with the transparent conductive layer lb.

Now, the exposure unit 2 provided in the photo-sensitive drum 1 formed in the above way will now be described with reference to FIG. 3.

The Figure shows the layout of the exposure unit. As shown, the unit comprises a printed circuit board 20 having LED chips 21 and drive ICs arranged in a row extending in the axial direction, an array of convergent lenses 23 (available under a trade name of "Cellfock Lens") disposed above the LED chip row 21, a head block 24 integrally supporting the printed circuit board 20 and lens array 23, a pair of end blocks 25 sealing the longitudinal ends of the head block 24, and a shaft 26 extending through the radial center of the drum.

The head block 24 is made of a non-transparent insulating material and has a slitted space 241 (not shown) having a sectional profile of an inverted letter T. The printed circuit board 20 is disposed on the lower horizontal surface of the slitted space. The lens array 23 is secured in a clamped state with its vertical center line aligned to the direction of emission of the LED elements 21*a* formed in an array on the top surface of the LED chip 21 of the above printed circuit board 20.

A connector 28 is provided on the bottom of the head block 24, and image information signal is transmitted through the connector 28 and a lead 29 connected thereto to drive ICs (not shown) mounted on the printed circuit board 20.

The exposure head 2 as shown above may be driven by a dynamic or a static drive circuit. In the case of the dynamic driving, the exposure head 2 has to have only a single drive IC and a single switching IC constituting a block designation circuit in addition to the row of LED chips 21. This structure thus may be disposed in a space adjacent a longitudinal end of the LED chip row. By so doing, the printed circuit board itself may be made narrow. In this case, the exposure head 2 may have a sectional shape with a height of 20 mm and a width of 14 mm so that it can be sufficiently inserted in the photo-sensitive drum 1 with a diameter of 30 mm, as shown in (B) in FIG. 3.

This exposure head 2 is inserted in the photo-sensitive drum 1 with a diameter of 30 mm, while the shaft 26 has its opposite ends provided with bearings 11A and 11B which have the same outer diameter as the inner diameter of the drum 1. The photo-sensitive drum 1 is mounted in the bearings 11A and 11B such that it is concentric with the exposure head 2.

Of the bearings 11A and 11B, the bearing 11B is mounted at a position a predetermined distance inward of the corresponding end of the drum to define a space, in which an outer rotor type electromagnetic motor 12 is mounted.

The outer rotor type electromagnetic motor 12 has an inner stator 12*a* and a ring-like outer rotor 12*b*, which is mounted on the ouater periphery of the stator 12*a* and has an outer diameter equal to the inner diameter of the drum. The stator 12*a* has an axial bore and is fittedly secured to the stationary shaft 26 penetrating the side blocks 25. The outer periphery of the rotor 12*b* is secured by screws or the like to the inner periphery of the drum 1.

With this structure, with the exposure head 2 held in position by the stationary shaft 26, the outer rotor type electromagnetic motor 12 is rotated, thus permitting the rotation of the photo-sensitive drum 1 alone.

Of course, instead of this drum drive system it is possible to drive the drum from an outer drive system through a gear mounted on the drum outer periphery.

The exposure head 2, as shown in FIG. 2, is mounted such that the focus position of the lens array 23 is deviated by about 4 degrees downstream in the direction of the drum rotation from the center-to-center line connecting the photo-sensitive drum 1 and development sleeve 30.

Figure 5:
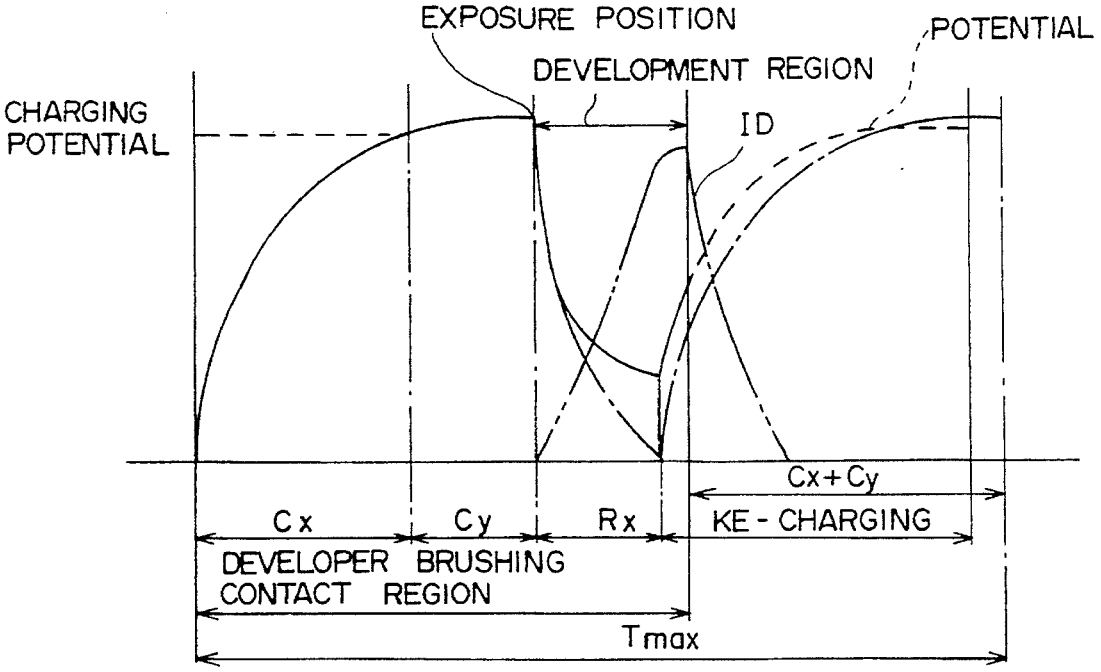
FIG. 5 is a graph showing the relation between charging time C and exposure time R in a brushing contact region.

Thus, the developer brushing region 10 formed between the photo-sensitive drum 1 and development sleeve 30, can be set to meet a relation $$Cx+Cy>Rx \quad (1A)$$

with respect to FIG. 5, with Cx representing a charging distance covered until reaching of a predetermined charging potential on the photo-sensitive drum 1 after the start of charging, Cy exposure distance, and Rx a distance from the exposure position to the end of the brushing contact region.

Denoting the line speed of the photo-sensitive drum 1 by A,

C=(Cx+Cy)/A, and

R=Rx/A.

Hence, from the formula (2) of C>R, we can obtain the formula (1A).

Now, the composition of the developer used with the development unit 3 will be described.

Figure 4:
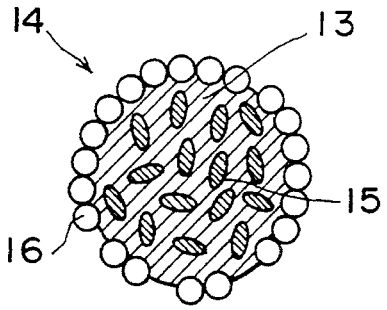
FIG. 4 is a schematic view showing a conductive magnetic carrier according to the invention.

FIG. 4 schematically shows the structure of carrier used for the developer. The carrier, designated at 14, comprises a mother carrier particle 13, which includes a binder resin and magnetic particles 15 uniformly dispersed therein, and conductive fine particles 16 secured to the surface of the mother carrier particle 13.

The carrier 14 has a volume resistivity of $10^6\Omega$.cm or below, preferably $10^4\Omega$.cm or below. If the volume resistivity is excessive, the characteristics the carrier as conductive carrier are spoiled. In such case, when the developer is used for the back side exposure system, quick charge injection can not be obtained, resulting in insufficient charging of the photo-sensitive drum. The carrier 14 is imparted with conductivity principally by the conductive fine particles 16.

The volume resistivity of the carrier 14 is measured by charging 1.5 g of carrier 14 into a Teflon cylinder, which has an electrode at the bottom and has an inner diameter of 20 mm, fitting an outer electrode with an outer diameter of 20 mm, and applying a load of 1 kg from above.

The magnetic force of the carrier 14 has to be higher than a certain value. Suitably, the maximum magnetization in the magnetic field of 5 kOe is 55 emu/g or above, preferably 55 to 80 emu/g. In the field of 1 kOe, it is suitably 45 emu/g or above, preferably 45 to 60 emu/g. If the magnetic force of the carrier 14 becomes insufficient, the conveying property of the developer is deteriorated. In addition, the carrier 14 is attached together with the toner in the development.

The average particle diameter of the carrier 14 is suitably 10 to 100 μm, preferably 15 to 50 μm. If the carrier size is excessive, it is difficult to obtain uniform charging of the photo-sensitive drum. In addition, it becomes impossible to increase the toner density T/C. If the carrier size is insufficient, on the other hand, the conveying property of the developer on the development sleeve is deteriorated. In addition, it is difficult to provided a predetermined potential.

The actual density of the carrier 14 is suitably 3.0 to 4.5 g/cm$^3$.

The magnetic particles may be of magnetite ($Fe_3O_4$), ferrite ($Fe_2O_3$), etc., preferably magnetite, although these materials are by no means limitative.

The conductive fine particles 16 may be of carbon black, tin oxide, conductive titanium oxide (i.e., titanium oxide with a coating of a conductive material), carbon silicate, etc. Desirably, they do not loose the conductivity due to oxidation by oxygen in air.

The binder resin used for the mother particle of the carrier 13 may be polystyrene type resins, e.g., vinyl type resins, polyester type resins, polyamide (under trade name of "Nylon") type resins, polyolefin type resins, etc.

For securing the conductive fine particles 16 to the surface of the mother particles 13 of the carrier, the mother particles 13 and conductive fine particles 16 are mixed uniformly, then the conductive fine particles 16 are attached to the surface of the mother particles 13 of the carrier, and then the conductive fine particles 16 are driven into the mother particles 13 by giving a thermal and/or mechanical impact force. The conductive fine particles 16 are thus buried in the mother particles not perfectly and such that they partly project from the mother particles 13.

By securing the conductive fine particles 16 to the surface of the carrier 14, it is possible to efficiently impart the carrier 14 with high conductivity. Further, since there is no need of providing conductive fine particles 16 in the mother carrier 13, a correspondingly large amount of magnetic material 15 may be provided in the mother particle 13 of the carrier, and the magnetic force of the carrier 14 can be correspondingly increased.

The developer is obtained by mixing the above carrier and toner in proportions of 80 to 90 versus 20 to 10% by weight.

As the toner, a usual high resistivity or insulating toner is used, which suitably has a volume resistivity of $10^{14}\Omega$.CM or above, preferably $10^{16}\Omega$.cm or above. It is formed as a magnetic toner by adding a magnetic material to a binder resin, a coloring material, a charge control material, an off-set prevention material, etc.

The operation of image formation in the above embodiment will now be described. The diameter of the development sleeve 30 is set to 30 mm. The sleeve is rotated in the counterclockwise direction at a rotational speed of 125 to 250 rpm while applying a DC voltage of +50 as development bias Vi to it.

The photo-sensitive drum 1 is rotated in the opposite direction, i.e., in the clockwise direction, at a rotational speed of 25 rpm. The gap between the photo-sensitive drum and development sleeve is set to 0.4 to 0.55 mm. The pole position of the stationary magnet assembly 33 is set at an angle of 2 degrees upstream the closest position of the drum and sleeve to each other in the direction of the drum rotation. The magnetic field intensity of the pole is set to 800 Gauss.

As for the exposure head 2, the drive current is set such that the exposure energy supplied to the photo-sensitive drum 1 is 0.1 μJ/cm$^2$ or above. The head is driven by time division driving (i.e., dynamic driving) such that the light emission time is 5 to 50 μs.

Under the above conditions, the power source is turned on, and initial checks are effected before the start of the printing operation. When the printing operation is started, the electromagnetic motor 12 is turned on, then a drive motor (not shown) in the development unit 3 is turned on to cause rotation of the development sleeve 30 and mixers. At the same time, the check of the toner density by the sensor 36 is started. When the developer brushing contact region 10 has been formed between the the photo-sensitive drum 1 and development sleeve 30 with the rotation thereof, paper feed from the resist roller 7 is caused, while simultaneously starting the exposure caused by the exposure head 2, thus obtaining predetermined image formation.

More specifically, as shown in FIG. 2, with the rotation of the sleeve and drum in opposite directions (in forward feed at the development position), the brushing contact region 10 is formed such that that it covers distances of 4 to 6 mm and 1.5 to 2 mm on upstream and downstream the exposure position, respectively. With the application of the development bias in this state, charge is injected into the photoconductive layer of the drum via the carrier in the brushing contact region. The surface potential on the drum thus eventually reaches saturation.

Upon reaching of the saturation, the exposure is made. Simultaneously with the exposure, the development is started. The drum passes by the developer pool subsequent to the exposure position and gets out of the brushing contact region. In practice, it was possible to prevent image density reduction or fog that might otherwise be caused by re-charging due to subsequent brushing of the carrier and also prevent disturbance of image due to mechanical brushing by the toner, thus obtaining high quality image.

In this embodiment, the time C until reaching of a predetermined charging potential on the photo-sensitive drum after the start of the charging, the time R until attenuation of the charging potential to a latent image potential caused by the exposure, and the time T until clearing of the brushing contact region by the drum, were measured and found to be 13, 10.5 and 1.5 msec., respectively. It was thus confirmed that the formulas (1) to (3) could be satisfied. The times T, C and R are determined by the combination of various conditions or specifications such as the diameter and rpm of the drum and sleeve, gap, developer height, etc.

Further, since in this embodiment the toner is an insulating toner, when the toner is attached to the latent image areas, subsequent re-charging is prevented except for that the attached toner is removed by mechanical brushing. In addition, the toner can be readily held on the latent image areas until the execution of the transfer step.

The toner attached to the latent image areas is transferred to ordinary paper by the transfer roller 4 and then thermally fixed by the fixing roller 8.

Now, a durability test conducted with respect to the invention will be described. In the test, the ration (by weight) of the conductive magnetic carrier to the insulating magnetic toner was set to 85% to 15%, the initial resistance $Rt_1$ of the developer was set to $1\times10^4\Omega$ (corresponding to a resistivity $\rho$ of $3\times10^6$ $\Omega$.cm), and a DC voltage of +50 V was applied as the development bias Vs, thereby producing 15,000 prints. From the initial stage of development till the last print, images with the image density ID of 1.3 or above could be obtained. In addition, neither ghost or fog was generated.

After the production of the 15,000 prints noted above, the resistance $Rt_2$ of the developer was $2\times10^5\Omega$ (corresponding to a resistivity $\rho$ of $6\times10^7\Omega$.cm). Further, with the LED head 2 set at the position slightly (i.e., about 4 degrees) downstream the center-to-center line connecting the drum 1 and sleeve 30 in the direction of rotation of the drum, the developable voltage Vc could be held to be 8 V or above.

By substituting Vc of 8 V, Vs of 50 V and Rh (bright resistance) of $2.0\times10^6\Omega$ for verifying the effect of the invention, $$\begin{aligned} Vc/(Vs - Vc)Rh &= 8/(50-8)2.0\times10^6\Omega \\ &= 3.8\times10^5\Omega(\text{limit value}). \end{aligned}$$

The developer resistance $Rt_1$ of ($1\times10^4\Omega$) in the initial stage and that $Rt_2$ of ($2\times10^5\Omega$) after the production of 15,000 prints are both below the limit noted above, thus satisfying the requirements according to the invention.

To further verify the effect according to the invention, 15,000 prints were produced as a comparative example under the same conditions as above except for varying the ratio of the carrier to the toner to set the initial stage developer resistance $Rt_1$ to $1\times10^5\Omega$. In the initial state of development, images with the image density ID of 1.3 or above could be obtained without generation of ghost or fog. However, after the production of about several 1,000 prints, ghost and fog were produced.

The developer resistance $Rt_2$ confirmed after the production of 15,000 prints was $1\times10^6\Omega$.

It was thus understood that the developer resistance satisfies the formula (1) in an initial state of the development and fails to satisfy the formula (1) in the subsequent stage, thus permitting the confirmation of the effect according to the invention.

Next, the relation between the image density and the sleeve rpm was examined by setting the rotational speed of the photo-sensitive drum 1 and to 25 rpm and varying the rotational speed of the development sleeve 30 in a range of 0 to 300 rpm.

A DC voltage of +50 V was applied as the development bias Vi. The diameter of the drum and sleeve was set to 30$\phi$, and the gap between them was set to 0.5 mm.

The LED head 2 was driven by dynamic driving such that the exposure energy was 0.35 J/cm$^2$ above and that the light emission time was 5 to 50 $\mu$s.

Figure 6:
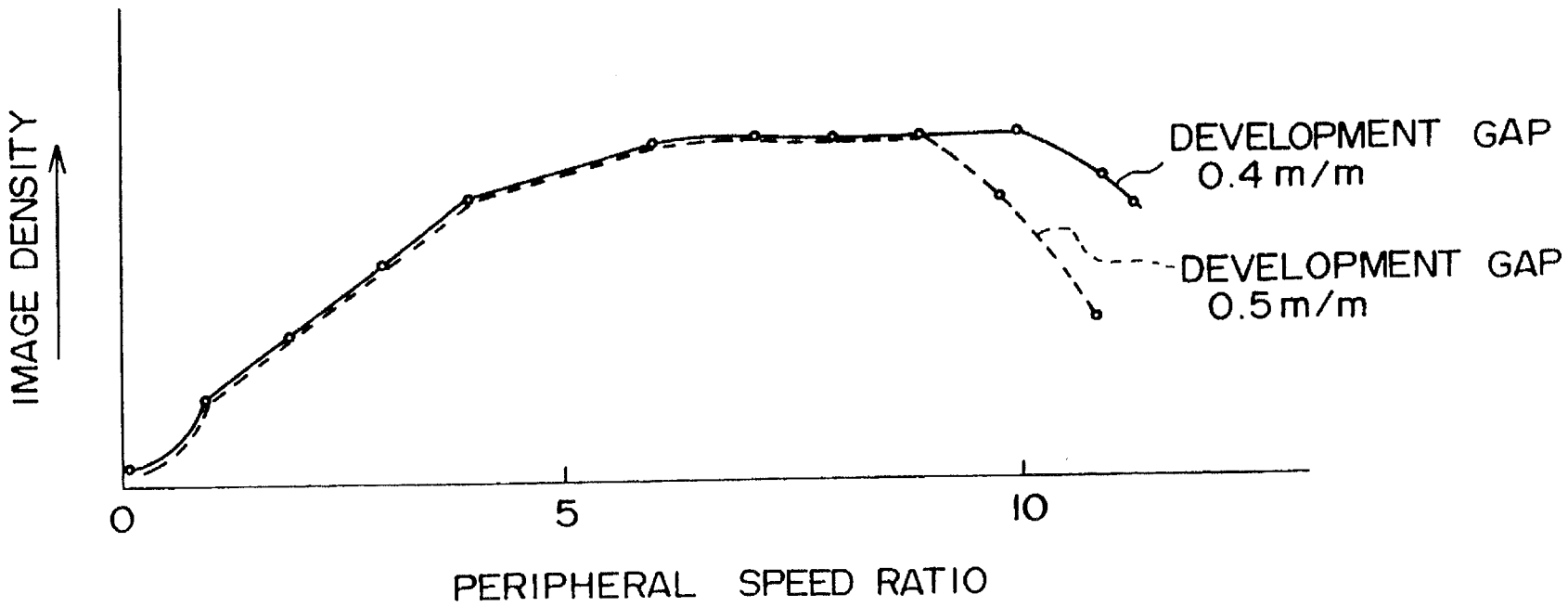
FIG. 6 is a graph showing the relation between image density and line speed ratio between sleeve and drum.

Under the above conditions, a relation between the image density and the sleeve rpm as shown in FIG. 6 by the dashed curve could be obtained. As is seen from the curve, the image density was increased until the line speed ratio of the sleeve to drum increased to five times, stabilized while the speed ratio increased from five to nine times, and is reduced sharply after the ratio exceeded ten times.

A similar experiment as above was conducted by reducing the development gap to 0.4 mm. In this case, it was confirmed that the stable ratio region extended to about ten times, as shown by the solid curve in FIG. 6.

From the above results, it is considered that the image density is lower due to defective charging until the reaching of five times the initial sleeve-to-drum line speed ratio and due to brushing and re-charging after development when the ratio exceeds ten times.

Further, the relation between the image density and the development gap (i.e., the distance of the closest portions of the drum and sleeve to each other) was examined by using an aluminum tube in lieu of the above photo-sensitive drum, setting the rotational speed of the sleeve to 200 rpm and setting the doctor blade gap to 0.5 mm. As a substituent characteristic for the image density, the current variations in individual regions 1 to 8 in the circle in FIG. 7 was examined.

More specifically, as shown in FIG. 7, variations of the development gap, variations of the downstream development nip width (in the exposure and development region) and the image density were examined. It was confirmed that with increase of the development gap beyond 0.6 mm the development nip width is reduced together with great reduction the current value, which influences the image formation on the upstream side of the exposure position.

It was also confirmed that with a development gap of 0.4 mm sufficient development nip width and current value were obtained. It was thus estimated that sufficient image density could be obtained even with a development gap of 0.3 mm.

Further, the relation between the image density and the pole position of the stationary magnet assembly accommodated in the sleeve was examined under the same conditions as above.

Figure 8:
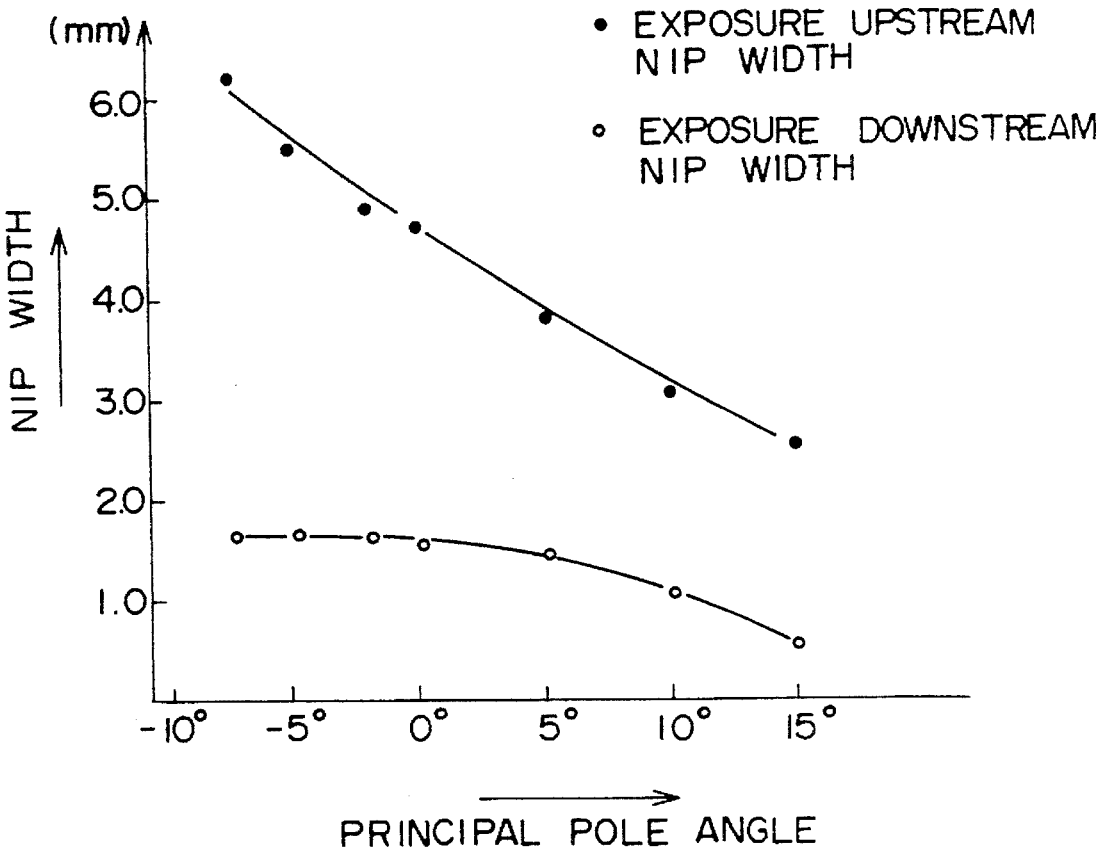
FIG. 8 is a graph showing the relation between development nip width and main pole angle of a stationary magnet assembly.

More specifically, as shown in FIG. 8, the position of the principal pole of the stationary magnet assembly is varied with respect to the position of the closest portions of the drum and sleeve to each other to examine corresponding variations of the development nip width upstream the exposure position (charging region) and downstream (exposure and development region). It was confirmed that on the downstream side (i.e., in the exposure and development region) which has influence on the image formation, the variation of the development nip width is less than that on the upstream side because of the forward feed rotation, and stable image formation could be obtained. Further, when the principal pole is set on the upstream side, the development nip width is less varied, but with downstream side setting of the exposure position it is reduced sharply, thus having adverse effects on the image formation.

Further, the relation between the image density and the pole position of the stationary magnet assembly accommodated in the sleeve was examined under the same conditions as above.

Figure 11:
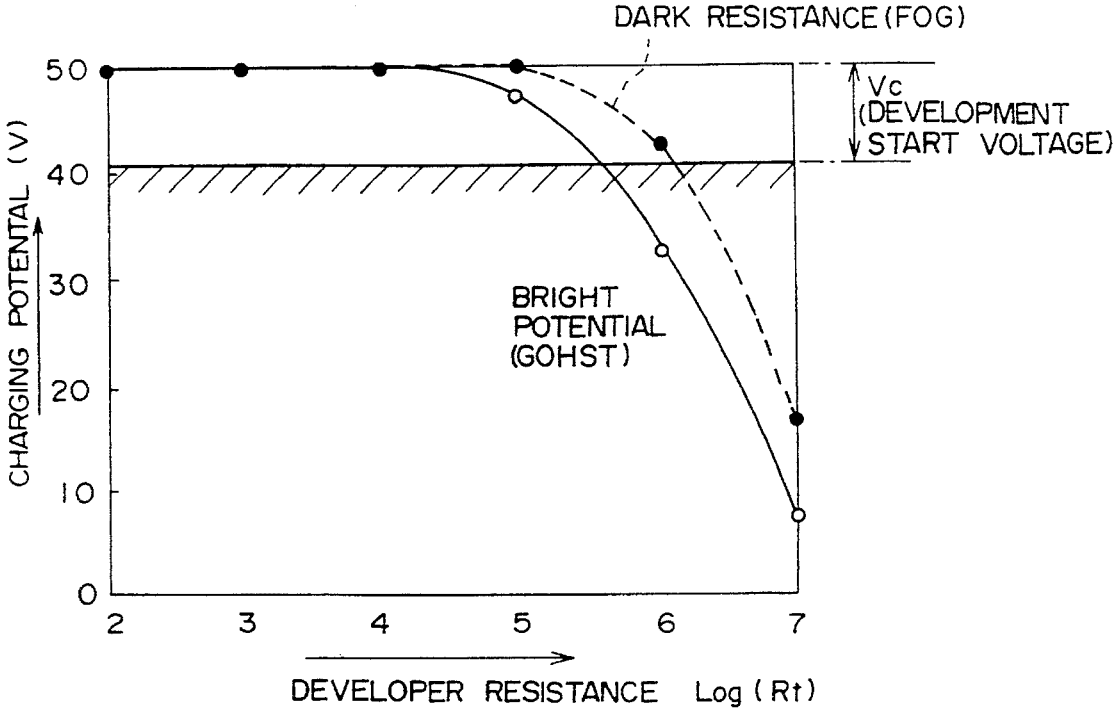
FIG. 11 is a graph showing the relation between charging potential Vc and developer resistance Rt.
Figure 12:
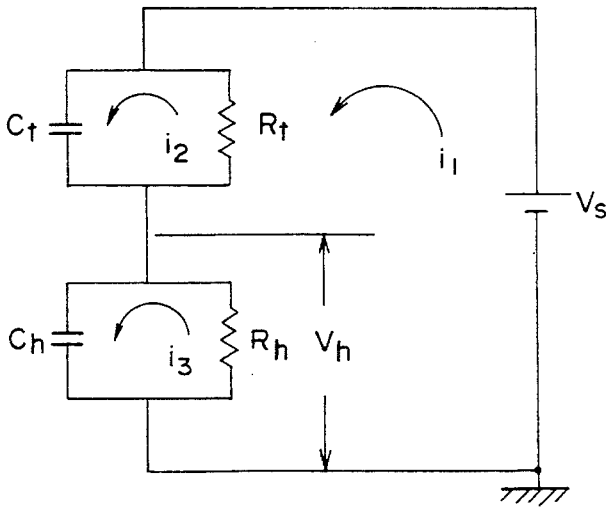
FIG. 12 is a circuit diagram showing an equivalent circuit for explaining the relation between development bias voltage Vs and charging potential Vh.
Figure 13:
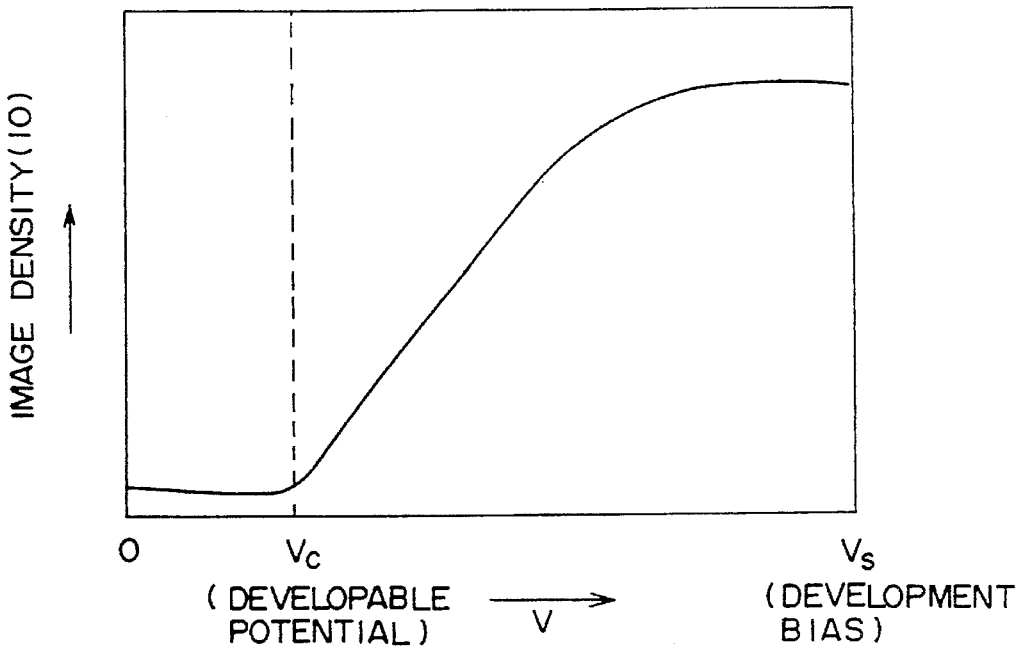
FIG. 13 is a graph showing a development $\gamma$ characteristic representing the relation between image density and development bias voltage Vs minus charging potential Vh on photo-sensitive member.
Figure 14:
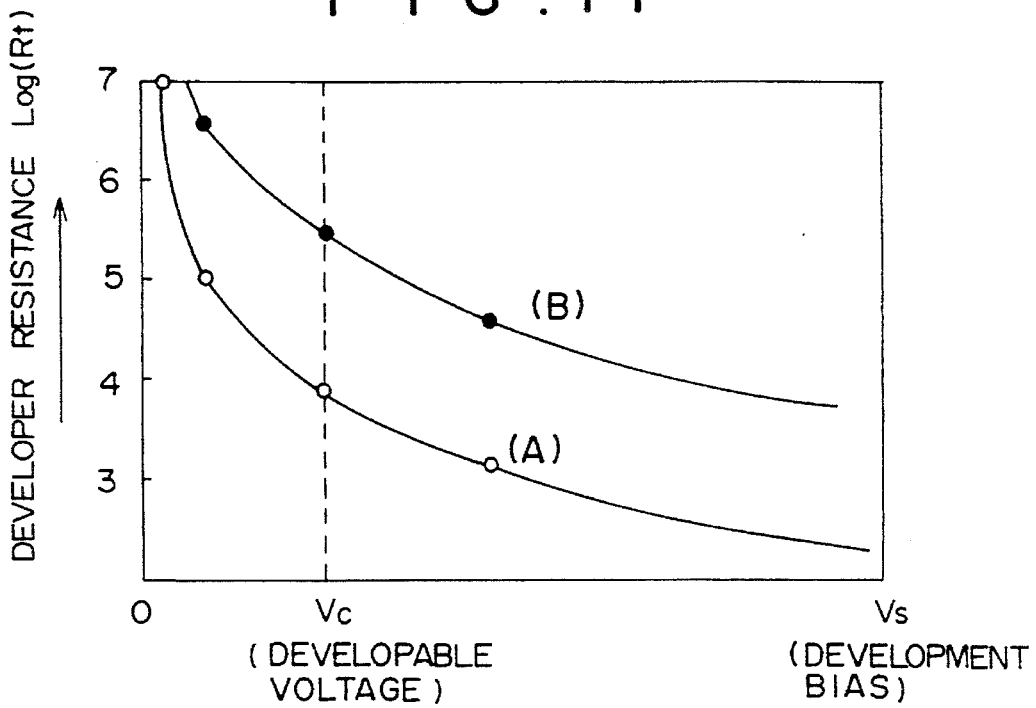
FIG. 14 is a graph showing the electric field dependency of the resistance of two-component developer used with an embodiment of the invention, with curve (A) showing the electric field dependency in an initial stage of development and curve (B) showing the electric field dependency after obtaining a predetermined number of prints.

More specifically, as shown in FIG. 11, variations of the development nip width upstream (charging region) and downstream (exposure and development region) the exposure position was examined by varying the position of the principal pole of the stationary magnet assembly. It was confirmed that the development nip width was less varied on the downstream side (exposure and development region) in case when the principal pole was set upstream the exposure position. The development nip width is less varied on the upstream side compared to the downstream side, and this is so because the closest portions of the drum and sleeve form a dam to permit constant flow.

Further, the relation between the image density and the development sleeve diameter was examined. As the development sleeve 30, those with diameters of 30 and 20 mm were prepared. The photo-sensitive drum 1 was set for clockwise rotation at a rotational speed of 25 rpm. The development sleeves were set for counterclockwise rotation at a speed of 200 and 300 rpm in the case of the respective diameters of 30 and 20 ϕ. In other words, their rotational speed was set such that their line speed was eight times the line speed of the drum. The gap between the drum 1 and sleeve 30 was set to 0.5 mm.

In this state, full exposure and 25% exposure were done. The full exposure was done by applying a DC voltage of +50 V as the development bias Vi. The 25% exposure was done by time division driving with an exposure energy level of 0.35 $\mu J/cm^2$ and a LED light emission time of 20 μsec. while causing the swing of the LED unit 2 with respect to the position, at which the drum and sleeve are closest.

Figure 9A:
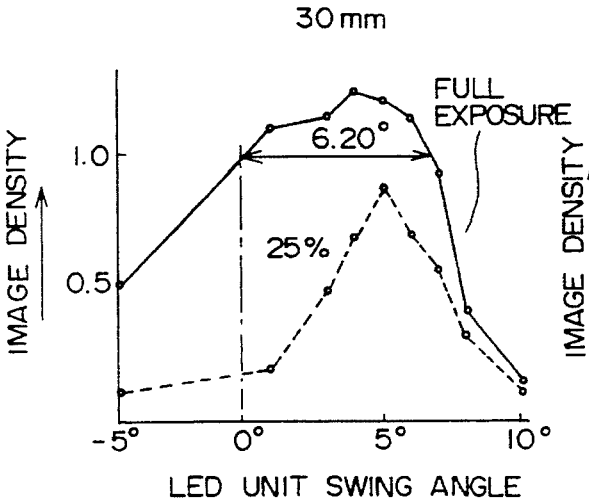
FIG. 9 is the graphs showing the relation between development density and development sleeve diameter.
Figure 9B:
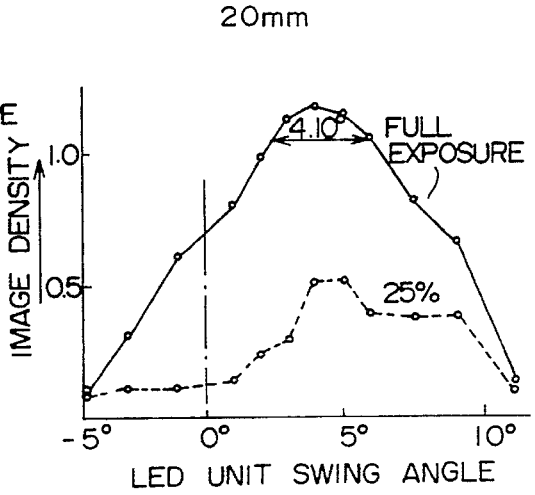

FIGS. 9(A) and 9(B) show the relation between the image density and the LED swing angle with the development sleeves with the diameters of 30 and 20 mm, respectively.

Figure 9C:
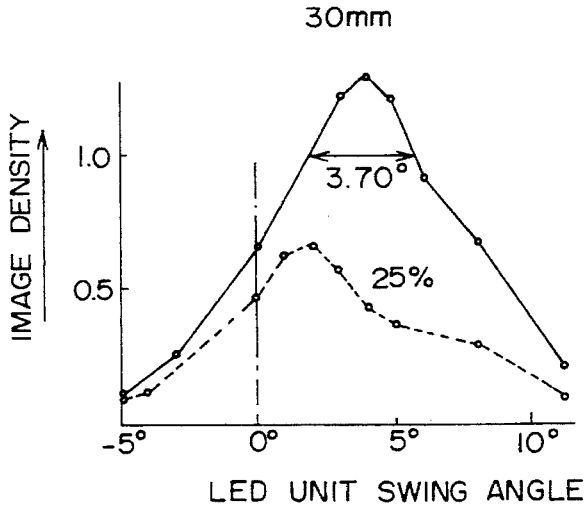
Figure 9D:
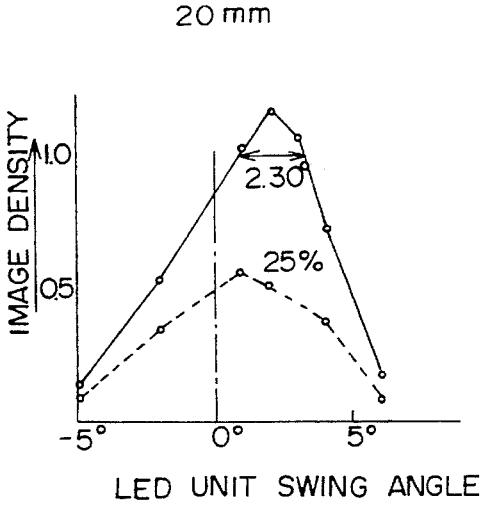

FIGS. 9(C) and 9(D) show the results of a further experiment conducted under the same conditions as above except for rotating the development sleeves in the opposite direction, i.e., the clockwise direction, at predetermined rotational speeds of 150 and 250 rpm with the sleeves with the diameters of 30 and 20 ϕ, respectively, for obtaining counter feed rotation and the same line speed as above.

In consequence, with the forward feed rotation of the sleeve with the diameter of 30 ϕ, in the full exposure the swing angle of the LED unit 2 for attaining image density of 1.0 or above was 6.2 degrees. In the 25% exposure, the swing angle of the LED unit for attaining satisfactory image density of about 0.6 to 0.8 was 4 to 6 degrees.

Meanwhile, with the forward feed rotation of the sleeve with the diameter of 20 ϕ, in the full exposure the swing angle of the LED unit 2 for attaining image density of 1.0 or above was reduced to 4.1 degrees. Also, in the 25% exposure, the swing angle of 4 to 5 degrees reduced to image density about 0.5 maximum.

With the counter feed rotation of the sleeve with the diameter of 30 ϕ, in the full exposure the swing angle of the LED unit for attaining image density of 1.0 or above was 3.7 degrees. In the 25% exposure, on the other hand, the satisfactory image density of about 0.6 to 0.7 could be attained in the swing angle of LED unit 1 to 3 degrees. With the sleeve with the diameter of 20 ϕ, satisfactory results could be obtained in both the full and 25% exposure.

To confirm the effect of the invention, an experiment was conducted with forward feed rotation of the sleeve with the diameter of 35 ϕ in the same manner as above except for that the rotational speed was reduced to 170 rpm. In consequence, substantially the same result as in FIG. 9(A) could be obtained.

From the above results of experiments, it can be understood that what is most suitable is the forward feed rotation with the sleeve diameter set to be equal to or greater than the drum diameter and the sleeve line speed set to be higher than the line speed of the drum.

Further, the relation between the image density and the sleeve rpm was examined the sleeve with the diameter of 30 ϕ by setting the drum rpm to 25 rpm while varying the sleeve rpm in a range of 25 to 300 rpm.

The same conditions as in the above experiment with the forward feed rotation of the 30 ϕ sleeve were set. The gap at the position of the closest portions of the drum and sleeve was set to 0.5 mm.

Under the above conditions, a relation between the image density and sleeve rpm as shown by dashed plot in FIG. 6 could be obtained. As is seen, the image density is increased until the line speed ratio of the sleeve to the drum becomes five times, is stabilized while the ratio is in a range of 5 to 9 times and is reduced rapidly when the ratio exceeds 10 times.

A further experiment was conducted in the same manner as above except for that the development was reduced to 0.4 mm.

From the above results, it seems that the image density is lower due to defective charging until reaching of five times the line speed ratio of the sleeve to the drum and due to brushing and re-charging after development when the ratio exceeds ten times.

Further, the relation between the image density and the pole position of the stationary magnetic assembly in the sleeve was examined under the same conditions as above except for setting the gap to 0.5 mm.

Figure 10:
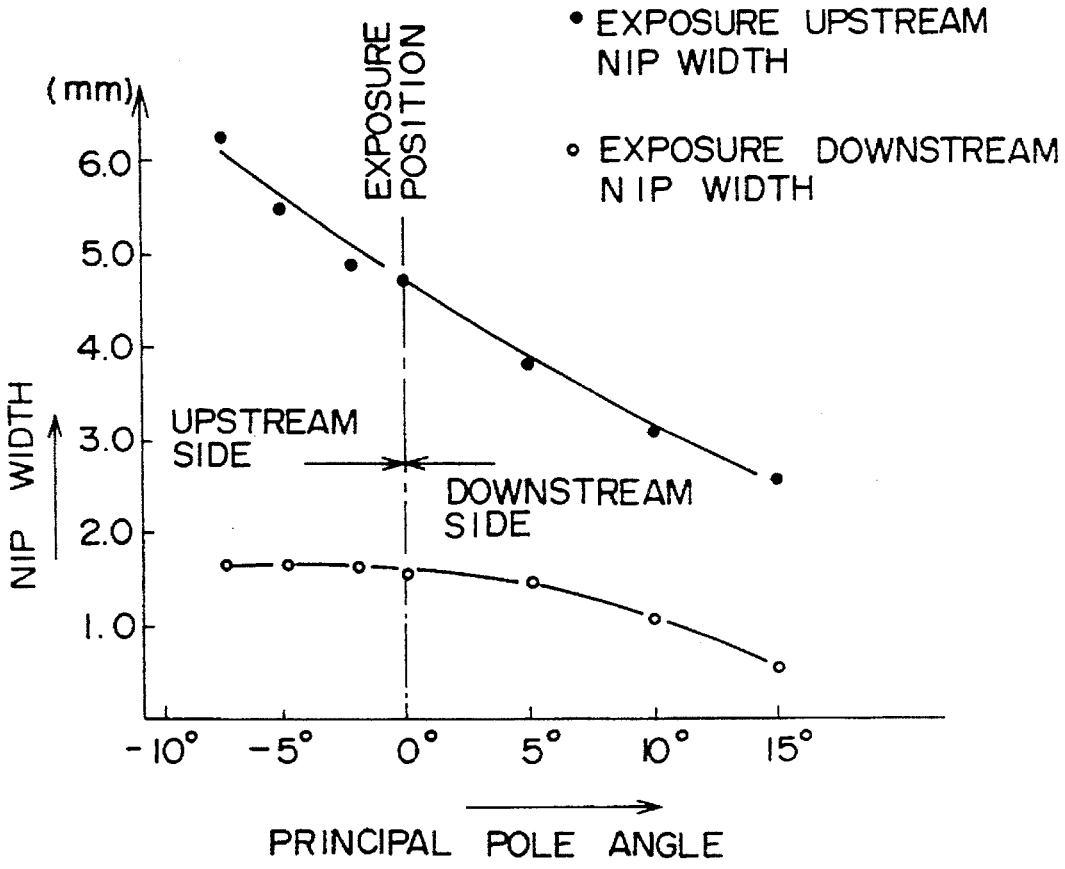
FIG. 10 is a graph showing the relation between development nip width and main pole angle of stationary magnet assembly.

More specifically, as shown in FIG. 10, the principal pole N1 of the stationary magnet assembly was swung with respect to the position of the closest portions of the drum and sleeve to examine the development nip variations upstream (charging region) and downstream (exposure and development region) the exposure position. On the downstream side (exposure and development region) which has influence on the image formation, the development nip width was less varied compared to the upstream side since the developer flow was restricted at the closest portion position owing to the forward feed rotation. It was thus confirmed that stable image formation was obtainable. Further, in the case of setting the principal pole at a position upstream the exposure position, the development nip width less varied. However, in the case of setting the pole at a downstream position, the development nit width reduced rapidly to adversely affect the image formation.

Further, the following experiment was conducted by altering the composition of the developer used in the developer unit 3.

The embodiment of the invention uses the three-component developer comprising a conductive magnetic carrier, a high resistivity magnetic carrier and a high resistivity toner, as proposed in the earlier technique noted before.

In this experiment, as in the above embodiment the conductive magnetic carrier used was of the structure with conductive fine particles secured to the surface of a mother particle of carrier of polyethylene or like binder resin with a magnetic material dispersed uniformly therein, the carrier having an average particle diameter of 30 μm, a specific gravity of 2.70 and a volume resistivity of $10^1$ to $10^6$ Ω.cm, specifically $10^3$ Ω.cmm.

The high resistivity magnetic carrier was of a structure with a magnetic material dispersed uniformly in a phenol resin or like binder resin, and had an average particle diameter of 60 μm, a specific gravity of 1.82 and a volume resistivity of $10^{11}$ Ω.cm or above, for instance $10^{13}$ Ω.cm.

The high resistivity non-magnetic toner used was prepared by adding, to a polyester resin, a charge controller, etc. together with a pigment (i.e., of quinadoline type in the case of magenta, of phthalocyanine type in the case of cyan and azo or disazo type in the case of yellow), kneeding the system to obtain a homogenious material and then pulverizing and sieving the material, and had an average diameter of 10 μm, a specific gravity of 1.25 and a volume resistivity of $10^{11}$ Ω.cm or above, for instance $10^{13}$ Ω.cm.

The above multiple carriers and the toner are mixed together to obtain the developer.

In this instance, the proportions of the high resistivity non-magnetic toner, high resistivity magnetic carrier and conductive carrier were set to 10, 10 and 80%, respectively.

The weight ratio of the toner to each of the carriers was set to 1:6.6 (for the high resistivity magnetic carrier) and to 1:8.6 (for the conductive carrier). In either case, it was 1:4 or more.

Such developer was used with the apparatus shown in FIG. 1 for examining the nip width of the brushing contact region formed between the photo-sensitive drum 1 (with diameter of 30 mm) and the development sleeve 30 (with diameter of 30 mm) with the line speed of the sleeve 30 controlled to 228 mm/sec. and the line speed of the drum 1 controlled to 38 mm/sec (i.e., with the line speed ratio of 6:1 and the line speed difference of 420 mm/sec.). It was found that the overall nip width was 5 to 7 mm, and the nip width downstream the exposure position in the brushing contact region in the direction of the drum rotation was 2 to 3 mm.

Figure 15:
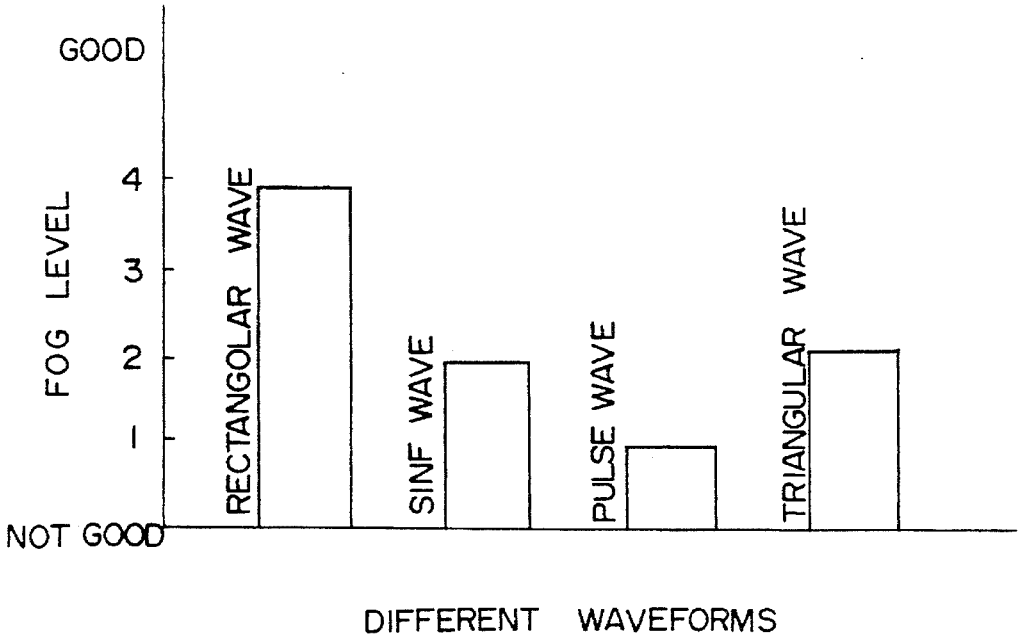
FIG. 15 is a graph showing the fog level with various waveforms.

FIG. 15 shows the status of fog generated when the development sleeve of the apparatus is biased development biases of a rectangular wave having a frequency of 100 Hz and an amplitude of 50±20 V, a sine wave having a frequency of 100 Hz and an amplitude of 50±20 V, a triangular wave having a frequency of 100 Hz and an amplitude of 50±20 V and a pulse wave with respect to the ground having a frequency of 100 Hz and an amplitude of 50 V to 0 V.

As is obvious from the Figure, the most satisfactory fog reduction effect could be obtained with the rectangular wave development bias. With the sine and triangular waves predetermined fog reduction effects, although not satisfactory, could be obtained.

With the pulse wave, however, no substantial fog reduction could be obtained while the print density was reduced because of the reduction of the charging potential.

Figure 16:
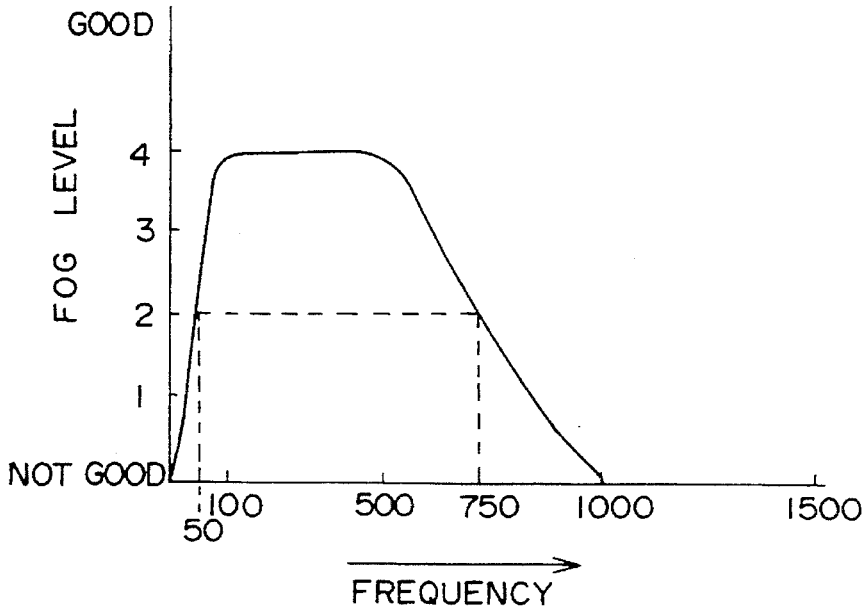
FIG. 16 is a graph showing the relation fog level and frequency.

FIG. 16 shows the status of fog generated by varying the frequency of the above rectangular wave with the amplitude of 50±20 V.

As is seen from the Figure, the most satisfactory fog reduction effect could be obtained in a development bias frequency range of 100 to 550 Hz. When the frequency exceeds 550 Hz, the fog reduction effect turns to be reduced gradually. When the frequency is increased beyond 1,000 Hz, the situation is the same as the application of a DC bias, and the fog generation can not be prevented.

When the frequency is reduced to be lower than 100 Hz, the fog reduction effect is reduced rapidly, and at a frequency of 20 Hz or below horizontal streaks are generated on the photo-sensitive drum.

It is to be appreciated that with a photo-sensitive drum line speed Sd of 38 mm/sec., and the nip width Nw downstream the exposure position in the direction of the drum rotation of 2 to 3 mm, the frequency of at least the oscillating waveform bias used according to the invention is suitably not lower than the value in the formula (7) and not higher than 1,000 Hz, preferably 50 to 750 Hz.

Figure 17:
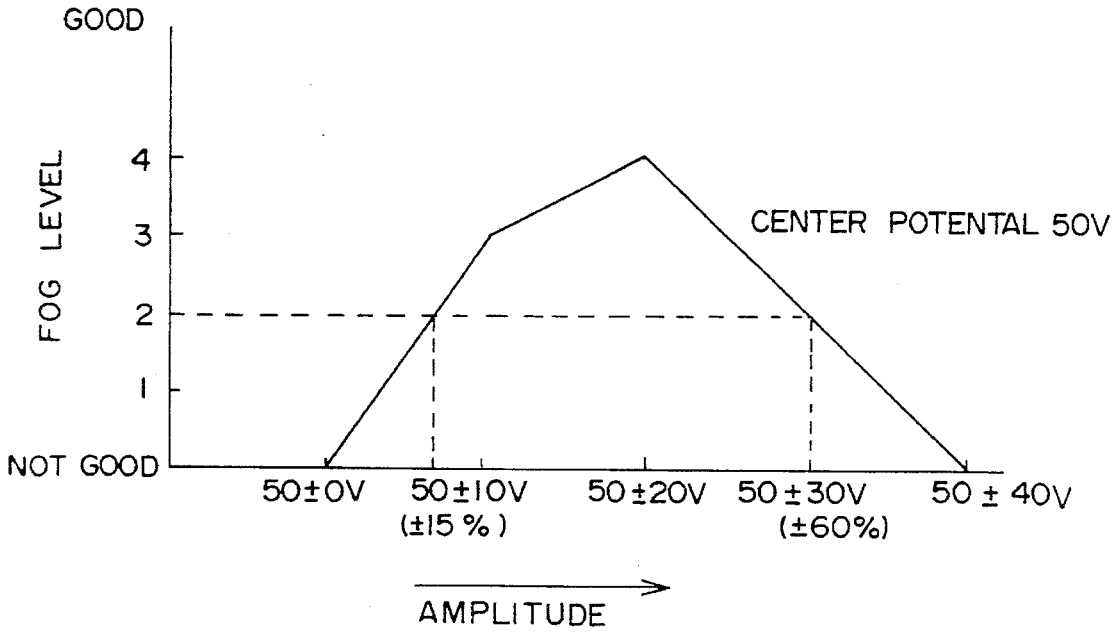
FIG. 17 is a graph showing the relation between fog level and amplitude of waveform.

FIG. 17 shows the status of fog generated by varying the amplitude of the 100 Hz rectangular wave by 10 V at each time.

As is obvious from the Figure, the most satisfactory fog reduction effect can be obtained with a development bias amplitude of ±10 to ±30 V, preferably around ±20 V. With amplitude reduction from ±10 V and below or amplitude increase beyond ±30 V the fog reduction effect is reduced gradually. When the amplitude becomes lower than ±0 V (DC bias) or higher than ±40 V, the fog generation can no longer be prevented.

Thus, it is to be understood that according to the invention the amplitude noted above is suitably within ±15 to ±60% of the photo-sensitive member charging potential.

The above description of the embodiment according to the invention concerned with the application of the oscillating waveform bias to a three-component developer.

However, as will be understood from the content of the above description, the same effects are obtainable by applying the oscillating waveform bias to a two-component developer comprising a high resistivity non-magnetic toner and a conductive magnetic toner.

In other words, if the conductive magnetic carrier is capable of charging the toner to a certain extent by friction charging, it is possible to obtain clear image free from fog with an oscillating waveform bias.

What is claimed:

1. An image forming apparatus, comprising:

a moveable photosensitive member defining a first side and a second side and comprising an endless transparent support member, a transparent conductive layer, and a photoconductive layer, exposure means disposed on the first side of the photosensitive member for exposing the photosensitive member to image information, a toner holder for holding a developer disposed on the second side of the photosensitive member, a brushing contact region defined between the photosensitive member and the toner holder for enabling charging of the photosensitive member and exposure of the photosensitive member, wherein movement of the photosensitive member relative to the brushing contact region is controlled in accordance with the equations:

$$C+R<T \text{ and } C>R,$$

where

C represents the time required to attain a predetermined charging potential on the photosensitive member in the brushing contact region, R represents the time required to attenuate the predetermined charging potential by exposure to a latent image potential, and T represents the time required for a section of the photosensitive member to pass the toner brushing region, wherein the photosensitive member defines a resistance and a potential, wherein the developer defines a resistance, and wherein the resistance of the developer satisfies the equation:

$$Rt<(Vc/Vs-Vc)Rh$$

where

Rt represents the resistance of the developer when a developable voltage Vc is applied to the developer, Vs represents a development bias voltage applied to the developer holder, Vc represents a development bias voltage minus the potential of the photosensitive member when inverse development is started, and Rh represents the resistance of the photosensitive member.

2. The apparatus of claim 1, wherein the photosensitive member comprises an a-Si type material.

3. The apparatus of claim 1, wherein the moveable photosensitive member defines a downstream direction and an upstream direction, the brushing contact region defines a center and a first area located in the downstream direction relative to the center, the developer comprises at least one conductive carrier having at least a conductive surface and at least one of a high resistivity toner and an insulating toner, and wherein the exposure means exposes the photosensitive member to image information at a location in the first area of the brushing contact region.

4. The apparatus of claim 1, wherein the toner holder comprises a rotatable development sleeve defining a line speed, wherein the photosensitive member comprises a rotatable photosensitive drum defining a line speed, and wherein the line speed of the development sleeve is greater than the line speed of the photosensitive drum.

5. The apparatus of claim 4, wherein the photosensitive drum defines a downstream direction and an upstream direction, the photosensitive drum and the development sleeve mutually define a first location at which the distance between the photosensitive drum and the development sleeve is minimized, and a first area located in the downstream direction of movement relative to the first location, wherein the exposure means exposes the photosensitive member to image information at a location in the first area.

6. An image forming apparatus, comprising:

a moveable photosensitive member defining a first side and a second side and comprising an endless transparent support member, a transparent conductive layer, and a photoconductive layer, exposure means disposed on the first side of the photosensitive member for exposing the photosensitive member to image information, a toner holder for holding a developer disposed on the second side of the photosensitive member, a brushing contact region defined between the photosensitive member and the toner holder for enabling charging of the photosensitive member and exposure of the photosensitive member, wherein movement of the photosensitive member relative to the brushing contact region is controlled in accordance with the equations:

$$C+R<T \text{ and } C>R,$$

where

C represents the time required to attain a predetermined charging potential on the photosensitive member in the brushing contact region, R represents the time required to attenuate the predetermined charging potential by exposure to a latent image potential, and T represents the time required for a section of the photosensitive member to pass the toner brushing region, wherein the toner holder comprises a rotatable development sleeve defining a line speed, wherein the photosensitive member comprises a rotatable photosensitive drum defining a line speed, and wherein the line speed of the development sleeve is greater than the line speed of the photosensitive drum, and wherein the line speed of the development sleeve is between 5 and 10 times greater than the line speed of the drum.

7. An image forming apparatus, comprising:

a moveable photosensitive member defining a first side and a second side and comprising an endless transparent support member, a transparent conductive layer, and a photoconductive layer, exposure means disposed on the first side of the photosensitive member for exposing the photosensitive member to image information, a toner holder for holding a developer disposed on the second side of the photosensitive member, a brushing contact region defined between the photosensitive member and the toner holder for enabling charging of the photosensitive member and exposure of the photosensitive member, wherein movement of the photosensitive member relative to the brushing contact region is controlled in accordance with the equations:

$$C+R<T \text{ and } C>R,$$

where

C represents the time required to attain a predetermined charging potential on the photosensitive member in the brushing contact region, R represents the time required to attenuate the predetermined charging potential by exposure to a latent image potential, and T represents the time required for a section of the photosensitive member to pass the toner brushing region, wherein the toner holder comprises a rotatable development sleeve defining a line speed, wherein the photosensitive member comprises a rotatable photosensitive drum defining a line speed, and wherein the line speed of the development sleeve is greater than the line speed of the photosensitive drum, and wherein the development sleeve defines a diameter, wherein the photosensitive drum defines a diameter, and wherein the diameter of the development sleeve is not less than the diameter of the photosensitive drum.

8. The apparatus of claim 4, wherein the photosensitive drum and the development sleeve mutually define a first location at which the distance between the photosensitive drum and the development sleeve is between 0.3 mm and 0.55 mm.

9. The apparatus of claim 4, wherein the moveable photosensitive member defines an upstream direction and an exposure position, and comprising:

a magnet assembly accommodated in the development sleeve, the magnet assembly having a principal pole located in the upstream direction from the exposure position.

10. A back exposure image forming method, comprising:

providing a photosensitive member defining a rotational direction, a line speed and a rotational speed, providing a development sleeve defining a rotational direction, a line speed and a rotational speed, providing exposure means on the first side of the photosensitive member for exposing the photosensitive member to image information, forming a brushing contact region between the photosensitive member and the development sleeve, charging the photosensitive member with a development bias applied in the brushing contact region, accommodating a stationary magnet assembly in the development sleeve, adjusting the rotational direction and speed of the development sleeve to provide forward feed rotation with respect to the photosensitive drum along the brushing contact region and to provide a higher line speed for the development sleeve than for the photosensitive drum, setting an exposure position for the exposure means downstream from a position of the closest portions of the drum and development sleeve to each other in the direction of rotation of the photosensitive drum, wherein the development sleeve defines a line speed and the photosensitive drum defines a line speed and wherein causing the line speed of the development sleeve to exceed the line speed of the photosensitive drum by between 5 and 10 times.

11. The method of claim 10, wherein the photosensitive member defines a resistance and a potential, wherein the developer defines a resistance, and wherein the resistance of the developer satisfies the equation:

$$Rt<(Vc/Vs-Vc)Rh$$

where

Rt represents the resistance of the developer when a developable voltage Vc is applied to the developer, Vs represents a development bias voltage applied to the developer holder, Vc represents a developable voltage equivalent to a development bias voltage minus the potential of the photosensitive member when inverse development is started, and Rh represents the resistance of the photosensitive member.

12. The method of claim 11, wherein the photosensitive drum comprises an a-Si type material.

13. The method of claim 10, comprising the step of accommodating a magnet assembly in the development sleeve, the magnet assembly having a principal pole located at a position upstream from an exposure position in the direction of rotation of the photosensitive drum.

14. A back exposure image forming method, comprising:

providing a photosensitive member defining a rotational direction, a line speed and a rotational speed, providing a development sleeve defining a rotational direction, a line speed and a rotational speed, providing exposure means on the first side of the photosensitive member for exposing the photosensitive member to image formation, forming a brushing contact region between the photosensitive member and the development sleeve, charging the photosensitive member with a development bias applied in the brushing contact region, accommodating a stationary magnet assembly in the development sleeve, adjusting the rotational direction and speed of the development sleeve to provide forward feed rotation with respect to the photosensitive drum along the brushing contact region and to provide a higher line speed for the development sleeve than for the photosensitive drum, setting an exposure position for the exposure means downstream from a position of the closest portions of the drum and development sleeve to each other in the direction of rotation of the photosensitive drum, wherein the photosensitive drum defines a diameter not greater than 50 mm, and the development sleeve defines a diameter not less than the diameter of the photosensitive drum.

15. The method of claim 14, wherein the photosensitive drum and the development sleeve mutually define a development gap therebetween and wherein the development gap is between 0.3 and 0.55 mm.

16. An apparatus comprising a photosensitive drum facing a development sleeve and having a back side, and exposure means disposed on the back side of the photosensitive drum, the photosensitive member being charged by applying a development bias thereto in a brushing contact region formed between the photosensitive drum and the development sleeve, exposure being caused after the charging, development being caused at least one of simultaneously with and immediately after the exposure, the developer comprising a conductive magnetic carrier, a high resistivity magnetic carrier and a high resistivity or insulating toner, the development bias being an oscillating waveform bias having a maximum level higher than the charging potential on the photosensitive member and a minimum level higher than the exposure potential on the photosensitive member.

17. The apparatus of claim 16, wherein the toners and the carriers define a weight ratio and wherein the weight ratio of the toner to the carriers is not less than 1 to 4.

18. The apparatus of claim 16, wherein the oscillating waveform bias includes a superimposed DC component.

19. The apparatus of claim 16, wherein the rectangular waveform bias includes a superimposed DC component.

20. The apparatus of claim 16, wherein the frequency of the oscillating waveform bias is not higher than 100 Hz and satisfies the equation:

$$Hmin=1/DSd/Nw),$$

where

Hmin represents the minimum frequency of the development bias,

DSd represents the line speed of the photosensitive drum, and

Nw represents the nip width of the brushing contact region.

21. The apparatus of claim 16, wherein the amplitude of the oscillating waveform bias is in a range of ±20 to ±60% of the charging potential on the photosensitive member.

22. The apparatus of claim 16, wherein the high resistivity or insulating toner comprising a non-magnetic toner.

* * * * *